US012692606B1

(12) United States Patent
Blanchet et al.

(10) Patent No.: US 12,692,606 B1
(45) Date of Patent: Jul. 28, 2026

(54) DIRECT DC SOLAR-ELECTROLYSIS SYSTEM

(71) Applicant: EvolOH, Inc., Palo Alto, CA (US)

(72) Inventors: Scott Blanchet, Chelmsford, MA (US); James Gilchrist, Westford, MA (US); Michael Misiewicz, Windham, NH (US)

(73) Assignee: EVOLOH, INC., Palo Alto, CA (US)

( * ) Notice: Subject to any disclaimer, the term of this patent is extended or adjusted under 35 U.S.C. 154(b) by 0 days.

(21) Appl. No.: 19/268,558

(22) Filed: Jul. 14, 2025

(51) Int. Cl.

| | |
|---|---|
| ***C25B 9/65*** | (2021.01) |
| ***C25B 1/04*** | (2021.01) |
| ***C25B 1/50*** | (2021.01) |
| ***C25B 9/73*** | (2021.01) |
| ***C25B 15/02*** | (2021.01) |

(52) U.S. Cl.
CPC ..... *C25B 9/65* (2021.01); *C25B 1/04* (2013.01); *C25B 1/50* (2021.01); *C25B 9/73* (2021.01); *C25B 15/02* (2013.01)

(58) Field of Classification Search
CPC .... C25B 9/65; C25B 1/04; C25B 1/50; C25B 9/73; C25B 15/02
See application file for complete search history.

(56) References Cited

U.S. PATENT DOCUMENTS

| | | | | |
|---|---|---|---|---|
| 4,341,607 | A | 7/1982 | Tison | |
| 2021/0079544 | A1* | 3/2021 | Harikumaran | C25B 15/00 |
| 2022/0186390 | A1* | 6/2022 | Montalvo | C25B 1/04 |
| 2023/0002920 | A1* | 1/2023 | Blanchet | C25B 9/77 |
| 2023/0340678 | A1* | 10/2023 | Huang | C22C 38/04 |
| 2023/0387690 | A1 | 11/2023 | Tao et al. | |
| 2024/0183048 | A1 | 6/2024 | Kestenberg et al. | |
| 2024/0327996 | A1* | 10/2024 | Tyler | C25B 15/08 |

FOREIGN PATENT DOCUMENTS

| | | | | |
|---|---|---|---|---|
| WO | WO-2024038308 A1 * | 2/2024 | | C25B 1/044 |
| WO | WO-2024170498 A2 * | 8/2024 | | H02J 3/28 |

OTHER PUBLICATIONS

International Search Report, PCT/US2025/037566, Oct. 6, 2025, 1 pg.

* cited by examiner

*Primary Examiner* — Bryan D. Ripa
(74) *Attorney, Agent, or Firm* — Paul D. Strain, Esq.; Strain & Strain PLLC

(57) ABSTRACT

The present invention relates to integrated systems of solar photovoltaic panels and water electrolyzers wherein the electrolyzer stacks are connected directly to the unregulated DC bus of the solar PV system. More specifically, the present invention optimizes electrolyzer cell count when connecting directly to the unregulated DC bus of a photovoltaic system to maximize annual hydrogen production capacity, minimize levelized cost of hydrogen produced, or track solar system maximum power point dynamically during operation.

18 Claims, 15 Drawing Sheets

DIRECT DC SOLAR-ELECTROLYSIS SYSTEM

FIELD OF INVENTION

The present disclosure relates to solar energy systems, more particularly, to specific arrangements of solar photovoltaic arrays directly connected to electrochemical systems (e.g., water electrolyzers) without the use of power conversion devices such as DC-DC voltage converters and DC-AC inverters, as well as related apparatuses and methods.

BACKGROUND

Photovoltaic (PV) solar panels are commercially available devices for converting solar radiation directly into electricity. Panels typically consist of two or more individual solar cells arranged in a planar array, wherein the cells are wired in a series-parallel network to achieve a particular rated voltage and current. Two or more individual panels may then be wired in a series-parallel network to achieve an overall voltage and current for a PV system. Panels wired in series may be referred to as a string. Strings wired in parallel may be referred to as a field. Several fields may then be wired in a series-parallel network to complete a system "array" or "network" with a specified voltage, current, and power based on an operational objective such as achieving a maximum peak power ("MPP") or a maximum energy production over time.

PV systems may typically be connected to the electrical transmission grid to deliver the energy produced to customers. PV cells produce direct current ("DC") electricity, whereas most grid customers demand alternating current ("AC") electricity; therefore, to connect PV systems the grid, DC must be converted to AC. This conversion process may require power conversion devices such as DC-DC voltage converters and DC-AC inverters. Specialty power management devices may also be added to the system for "maximum power point" (MPP) tracking, which converts the PV panel/string/field/system voltages and current in a way to ensure the maximum possible power is harvested under any specific weather conditions.

Interconnecting to the grid may also require specialized equipment and controls to ensure the grid is not adversely affected by the generated solar power such as AC step-up or step-down power transformers, power quality filters, power meters, and switches to disconnect the PV system from the grid. All these devices add significant capital and maintenance costs and reduce the efficiency and reliability of the solar PV system.

Additionally, regulatory requirements for interconnecting PV systems to a grid may stipulate certain operating conditions and requirements to ensure the safety, reliability, and quality of grid power for electricity customers in the presence of variable power output naturally produced by solar systems. These conditions may include interconnection fees and demand-response controls to disconnect the PV system and prevent overloading the grid during times of high solar production and low electricity demand. Due to the traditional cost and long timelines for grid upgrades and/or expansion, PV systems often need to be physically sited relatively close to existing grid substations (to avoid requiring construction of new grid infrastructure). Land close to existing substations, however, is typically more valuable and carries higher tax rates as compared to land situated more remotely from existing grid infrastructure.

Additionally, monetizing solar PV energy exported to the grid typically involves transacting in "renewable energy credits" or "RECs," as the grid is connected to non-renewable power sources and serves many power customers. The accounting system for these RECs may involve fees that add to the overall cost associated with solar PV energy production. Additionally, use of the grid may involve distribution and administrative charges for electricity delivery over long distances.

As is hopefully apparent based on the foregoing paragraphs, deploying PV systems for connections to the electricity grid is significantly more expensive than the cost of obtaining and installing PV panels. As more and more solar power has been deployed worldwide in recent years, the ability of the grid to accept additional, variable capacity power sources has diminished, making the approval to interconnect new PV capacity more and more difficult and, thereby, slowing the growth of new solar PV deployment. Additionally, some of the most productive locations for solar power (i.e., those with the highest capacity factors) may typically be far from existing electricity grids, such as North Africa, Middle Eastern deserts, the Australian Outback, and remote parts of South America.

Thus, there is a strong need for ways to site new PV capacity in productive and often remote locations without incurring the traditional costs associated with exporting the resulting power directly to grid infrastructure. Indeed, providing pathways to deliver the captured energy to customers without relying directly on the grid may be increasingly important to achieving a cost-competitive, net-zero carbon energy system for society. One solution described herein involves leveraging electrochemical cells to directly capture energy produced by PV equipment to drive endothermic chemical reactions, e.g. water electrolysis.

Electrochemical cells are devices for inducing chemical reactions using electricity or generating electricity using chemical reactions. If electricity is the output, the cells may be considered fuel cells or expander cells, depending on the chemical product. If electricity is the input, the cells may be considered electrolyzer cells, compressor cells or purifier cells, depending on the chemical product. For example, an electrolyzer takes electrical energy and stores it in a fuel such as hydrogen by splitting water into its constituent elements. In contrast, a fuel cell may be thought of essentially as an electrolyzer running in reverse—hydrogen and oxygen are provided to the cell, which then combines these molecules to form water, releasing electrical energy in the process. Other chemical reactions may be promoted by use of an electrochemical cell or a stack of cells such as the reduction of carbon dioxide into carbon monoxide, ethylene, or ethylene glycol, the reduction of nitrogen into ammonia or associated compounds, the formation of hydrogen peroxide from water and oxygen or the extraction of lithium from lithium brine solutions. The basic elements of these devices are two electrodes, an ion-conducting electrolyte, and an ion-permeable layer separating the two electrodes, although it is possible to operate an electrolyzer or fuel cell in a membrane-less configuration, as well. Electrochemical cells may also include a separator between the electrodes to prevent products from mixing inside of the cell. In the case of solid-electrolytic cells, the membrane and separator may be combined into a unitized, solid, ion-conducting layer. A complete electrochemical cell may also include flow fields for delivering reactants to the electrodes, seals for isolating reactants from each other and the environment, and one or more impermeable separator plates, also referred to as bipolar plates, for isolating one cell from adjacent cells in a stack and, in certain embodiments, for containing a separate cooling fluid for thermal management of the cell. Impermeability may be defined as a material having a permeability coefficient for a particular gas species of $<1.0\times10^{-11}$ [mol gas/(m s $Pa^{0.5}$)]. To produce a commercially relevant quantity of hydrogen, electrolyzer cells are typically arranged in a "stacked" configuration, wherein individual cells are place one on top of another, in electrical series to form a distinct "stack unit." Many stack units may then be connected in a series-parallel electrical network to scale the electrolyzer system to a specified input power or hydrogen capacity. Traditionally, engineering of these systems may be done by increasing the size of the cells, the number of cells per stack, or the number of stacks per system to increase the overall "scale" or capacity and lifetime production potential of the system. Generally, the levelized cost of hydrogen ("LCOH"), defined as the average, total cost of produced hydrogen ($/kg) accounting for all capital, utility, operating, and maintenance costs, may decrease continuously for electrolyzer systems as the scale of the system increases. Therefore, it is expected that lifetime hydrogen production potential may continue to increase and LCOH may continue to decrease as more cells of a given size are added to a fixed number of electrolyzer stacks in a green hydrogen system.

A variety of electrolytes can be used in electrochemical cells, including proton exchange membranes ("PEM"), anion exchange membranes ("AEM"), solid-oxide ceramic membranes ("SOEC"), and liquid alkaline solutions ("AWE") such as potassium and sodium hydroxides and potassium and sodium carbonates. Different electrolytes demand different operating conditions, and each comes with its own benefits and limitations. Advantages of PEM and AEM electrolytes may include relatively low operating temperature and a cell that can be constructed using a unitized-layer electrolyte/membrane. Electrolyzers using such membranes have the distinct advantage over other electrolyzers of being able to operate using relatively pure, liquid water, rather than a caustic solution or water vapor as a feed stock, thereby greatly simplifying the balance of system in practice. Relatively pure water may be defined as water containing no more than 5% by weight of elements other than hydrogen and oxygen. Such electrolyzers may also be operated without liquid water on the cathode, allowing production of hydrogen in a gas phase having non-zero vapor-phase moisture content. A non-zero vapor-phase moisture content may be defined as gas containing more than one part per million water vapor, by volume.

The impact of carbon dioxide on global climate change is well-documented. As society's efforts to address global climate change accelerate, the need for deep decarbonization of most or all human energy use has become clear and urgent. This objective has been referred to as "net zero," meaning the human energy system, on average, emits zero net carbon to the environment. The use of hydrogen as a carbon-free energy carrier is essential to reaching certain segments of human industry that are difficult or impossible to decarbonize directly with electricity. Examples of such segments include steel production, fertilizer manufacturing, construction, and heavy transport such as trucking, marine and air vehicles. In addition to these segments, the energy density and stable storage characteristics of hydrogen has made it one of the most viable candidates for seasonal-scale energy storage and establishment of grid resiliency using only renewable electricity, which may be required for complete conversion of energy use to carbon-free sources. With the accelerating demand for new energy from the information sector (data centers, artificial intelligence, etc.), there is also an interest in both long-term backup power and off-grid base load power systems to overcome the inherent available power limitations of the existing grid and high costs/long timelines for upgrading the grid to meet these new demands. These and other benefits have driven a high level of interest in "green hydrogen" production for both on- and off-grid energy systems.

Hydrogen is given a "green" label if it is produced by electrolysis from renewable electricity (wind, solar, hydropower, etc.). Other "colors" of hydrogen are conventionally assigned to other energy sources. The scale required to meet the potential demand for green hydrogen in the future global energy system is daunting. Production capacities for electrolyzers will need to increase by many orders of magnitude and their costs will need to be reduced by a factor of ten or more over the next decade to meet such demand. Up to now, production of hydrogen electrolyzers has been a niche industry with small systems and limited deployments based on cells and stacks designed for research and development. Only minor considerations have been made for the speed of manufacturing necessary to produce and assemble cells and stacks at a rate commensurate with society's eventual need. Additionally, the vast number of independent electrolyzer stacks that must be networked both fluidically and electrically to achieve the necessary scale has not been adequately considered. For instance, the configuration of electrical connections for many independent electrolyzer stacks may have a significant impact on variability, reliability, resiliency, efficiency, and/or lifetime of the stacks. The need to first convert solar PV power to grid AC power for delivery to the electrolyzer and then back to DC power to run the electrolyzer cells may add substantial costs, constraints, and delays to the deployment of green hydrogen for both hard-to-abate existing sectors as well as limiting the ability of hydrogen to enable renewables to meet the demands of new data centers and artificial intelligence capacity.

BRIEF SUMMARY

Electrolyzers require the input of DC electricity to split water. If electricity is taken from the power grid, AC electricity must be converted to DC using power electronics such as transformers and rectifiers. These power electronics systems may be large and expensive and may come with significant lead times for procurement, depending on the specifications and scale. To be considered "green" the electricity for hydrogen production must come from renewable sources. One such source is PV solar power.

As described above, PV panels produce DC electricity, but this is typically converted to AC for export to the grid. If an electrolysis system is then connected to the grid in order to access the renewable solar energy for making green hydrogen, the AC electricity must be converted back to DC for use by the electrochemical cell. These conversion steps require costly equipment, with long lead times, and result in significant energy losses in the conversion process, driving up costs. While avoiding the conversions between AC and DC seems self-evident, in practice the current state of the art presents challenges so significant that direct connection between PV and electrochemical systems on a commercial scale is more difficult and/or even more expensive than the traditional approach of converting from DC to AC for the grid and then back to DC from AC at the electrolyzer facility.

For example, typical electrolyzer input voltage levels are far below that of utility scale PV installations, driving the need for DC step-down conversion from utility-scale PV system voltage levels, which may be as high as 1,500 VDC today and 2,000 VDC or 3,000 VDC in the future. Additionally, today's state of the art electrolyzers require tightly controlled, "clean" (i.e., very low current ripple) DC power in order to achieve commercially acceptable lifetimes, as some electrolysis technologies may contain electrodes whose durability is significantly impacted by voltage cycling. Clean DC power may be defined as DC electricity with less than +5% voltage variation over a period of ≤1 second. Because of the variability inherent in PV systems, direct DC-DC connection between PV and electrolyzer installations require the use of custom, high-power, controllable, DC-DC power supplies. These bespoke power electronics suffer all the same limitations of the DC-AC-DC conversion process but are usually adapted from research applications and thus are typically sold in much lower volumes with much higher prices.

Furthermore, utility-scale PV systems are typically configured to run at the highest possible output voltage to minimize the current required for a given power level. This is important because the large land area of these systems naturally requires significant copper or aluminum wiring for interconnecting panels, strings, and fields. The lower the current, the smaller the wires may be, therefore the drive for the highest possible operating voltage. As of the filing of this application, that voltage may be approximately 1,500 VDC; however, the solar industry is reported to be working on standardization of safety codes and equipment specifications to increase this voltage to 2,000 VDC and higher.

Theoretically, an electrolyzer stack may be configured with any number of cells in series, with more cells allowing more power and higher input voltage, with the active area of the cells determining the allowable current through the stack. For proton exchange membrane (PEM), liquid alkaline (AWE), and anion exchange membrane (AEM) electrolyzers, the beginning of life voltage may be approximately 1.8V/cell. To achieve 1,500 VDC may therefore require more than 830 cells connected in series. This is many more cells than are typically placed in a state of the art commercial electrolyzer stack for at least one of the following reasons: 1) such high voltage exposed to the liquid-filled manifolds of the stack may result in excessive shunt currents, unwanted adverse reactions (e.g., in the manifolds themselves), and internal cell and stack corrosion; 2) the thickness (or "pitch") of typical electrolyzer cells may result in a mechanically unstable stack when built with this many individual cells. For example, a typical commercial PEM cell may have a pitch of 1 cm and an active area of 3,000 $cm^2$, and when stacked 800+ cells tall, to achieve the necessary voltage, may result in a stack over 800 cm long and only 50 cm wide. With an aspect ratio (length over width) of more than 10:1, such a stack may fail due to mechanical buckling under compressive loading. Therefore, state-of-the-art commercial electrolyzer stacks may be limited to 200 cells or less and 360 VDC or less in commercial applications. This limitation in voltage may be overcome by building shorter stacks and connecting them in electrical series. However, this approach may further exacerbate issues with shunt currents (item #1 above) as the external plumbing connecting the higher voltage stacks in series to the plant may establish additional ground shunt pathways through the inlet electrolyte directly to the balance of plant piping network. Similarly, the hydrogen outlet plumbing to the higher voltage stacks in such a system may also create a safety issue due to the potential for electrical arcing between the high voltage terminals in these stacks and the plant in the presence of hydrogen. It may be desirable to always connect water- and hydrogen-containing plumbing to a stack at the end close to earth ground to overcome such concerns, however, this may not be possible for all stacks when connecting them in series as described. Therefore, engineering of state-of-the-art, commercial electrolyzer system has focused on converting high voltage power from the grid (AC) or solar PV systems (DC) to lower voltage and higher current.

Recognizing the urgent need for large capacity electrolyzer plants for eliminating fossil fuel use, the present application is directed toward configurations for a combined solar PV-water electrolysis system that overcomes the limitations of the state-of-the-art and results in low cost of hydrogen. Embodiments of the present application are directed to the design, integration, and operations of those systems, and include innovative, networked arrangements of PV panels and stacks where stacks are directly connected to the unregulated electrical bus of the PV system. The term unregulated may be defined as an electrical wiring network without active voltage, current, or power management devices connected to the main output of the DC bus except for disconnection switches.

In some embodiments, substantially all electrochemical cells in the system receive operating power directly from the unregulated DC bus. In some embodiments, at least 80%, 90%, 95%, 99%, or 99.5% of the total power delivered to the electrolyzer system is provided directly from the DC bus without intermediate DC-DC voltage conversion or DC-AC inversion. Thus, in some embodiments, any DC-DC or DC-AC conversion present consumes less than 0.5%, 1%, 5%, 10%, or 20% of total system power. Accordingly, each electrolyzer stack, branch, or bank receiving more than 0.5%, 1%, 5%, 10%, or 20%, of total system power is electrically connected to receive operating current directly from the unregulated DC bus without intervening active power conversion devices.

The choice of network configuration for systems of this type may result in significant opportunities for optimizing operating performance, lifetime, and cost of hydrogen from the system. These opportunities may include: (a) optimizing the voltage-current matching between the unregulated DC bus of the solar PV system and the electrolyzer by choice of number of electrolyzer cells in a series-connected group; (b) maximizing the service life for the electrolyzer cells and stacks by choice of technology, stack, and network design; (c) operating at or near the MPP for the solar PV system to maximize solar energy capture by switching series-connected electrolyzer cell groups on or off as solar irradiance changes; (d) minimizing the LCOH produced by the system by direct DC connection of an electrolyzer stack module with an optimized cell group count to the unregulated DC bus of a solar PV system; and/or (e) minimizing the adverse effects of shunt currents on the electrolyzer cells and stacks by choice of stack/network design.

The description below will focus on water electrolysis for hydrogen production for clarity, but may be applied to other electrochemical processes such as hydrogen compressors, carbon dioxide electrolyzers, ammonia electrolyzers, lithium brine electrolyzers, and other electrochemical processes by one skilled in the art.

The basic process of water electrolysis involves providing water to a positively charged anode and conducting ions between the anode and a negatively charged cathode. Oxygen gas is produced at the anode while hydrogen gas is produced at the cathode. The particular ion conducted between the anode and the cathode depends on the electrolyte used. In an acidic cell (e.g., PEM), positively charged hydronium ions ($H_3O^+$) are conducted from the anode to the cathode. In an alkaline cell (e.g., AWE, AEM), negatively charged hydroxide ions ($OH^-$) are conducted from the cathode to the anode. In both systems, the overall reaction is the same: $(2)H_2O(l) \rightarrow (2)H_2(g)+O_2(g)$. Electricity must be provided to drive the reaction. The open-circuit, or thermo-neutral, voltage for the basic reaction of hydrogen to liquid water is 1.481 V, therefore a voltage higher than 1.481 V must be applied to a hydrogen electrolysis cell fed with liquid water to cause the reaction to progress (as discussed below, an overpotential is usually required for the reaction to proceed at acceptable rates). The size (i.e., active area) of the cell determines the rate of hydrogen/oxygen production from one cell at a given applied voltage. The total current required for a particular applied voltage may be proportional to the active area of the cell. In practical systems, multiple cells may be "stacked" on top of each other to increase production capacity. This stacking of cells results in the need to apply a higher voltage (integer multiple of the cell count) to drive the reaction. For example, a single cell of 1000 $cm^2$ active area may produce the same hydrogen flow as two stacked cells of 500 $cm^2$, but the 500 $cm^2$ stack will require an input of 2 times the voltage and ½ of the current. Flexibility in selecting required voltage and current may be a significant consideration in the design and cost of a total electrolysis system. For example, power supplies for higher current and lower voltage may be more expensive than those for higher voltage and lower current due to the size of the required electrical conductors and additional materials required for their construction. Therefore, an easily scalable cell active area is a significant advantage for cost and flexibility of deployment. Additionally, the ability to wire individual stack units in either series or parallel may provide further flexibility in trading higher voltage for lower current, thereby saving materials cost in the power supply.

Electrical connections between multiple stacks with a single power source may occur in series, in parallel, or a combination of these. Wiring stacks in series delivers the same current to both stacks and requires the power source to apply a voltage equal to the sum of that required for the two stacks. Wiring stacks in parallel applies a fixed voltage to the pair of stacks and requires the power source to deliver a current equal to the sum of the two stacks' current demand. In a network of stack units, stacks wired in series may be referred to as a "branch" while stacks wired in parallel may be referred to as a "bank". For example, a system of 6 total stacks with pairs of stacks wired in series and those pairs wired in parallel may have three total "branches" each containing 2 stacks and two unique "banks" each containing 3 stacks, where one bank is connected to the high voltage side and the other bank is connected to the low voltage side of the power source.

An electrolyzer stack module may, therefore, be configured with one or more stacks wired in a series-parallel network of branches and banks and the resulting network may have an effective impedance polarization characteristic (IPC) defined as the necessary voltage to deliver a defined current to the network. This characteristic may change over time as the stack module ages, and this characteristic may be adjusted in real time by disconnecting branches from the network with automatic or manual switches or disconnects. Likewise, a solar PV panel system may be configured with any number of panels in series and parallel to achieve a source polarization characteristic (SPC) defined as the maximum current available at a specified operating voltage when exposed to a given solar irradiance ($W/m^2$). This characteristic may also change over time with the age of the system and may be a function of the intensity, or irradiance, of the sunlight exposed to the system. When directly connecting an electrolyzer stack module to a solar PV system, the respective polarization characteristic curves may overlay to determine the natural, uncontrolled operating point for the combined system. Panel count and network arrangement for the solar PV system may be selected based on the total power desired for a certain application. Cell count, cell active area, and stack network arrangement may similarly be selected to create and IPC that best matches the defined SPC of the solar PV system. Here "best match" may be defined as optimizing an important plant operating parameter such as tracking of solar PV system maximum peak power (MPP) to achieve maximum instantaneous hydrogen capacity, maximizing lifetime hydrogen production, or minimizing lifetime cost of hydrogen.

Furthermore, the individual electrolyzer cells may be constructed with materials that exhibit better lifetimes under conditions requiring a high number of voltage cycles. In particular, electrodes may be configured to provide exceptional voltage stability and low degradation rates when exposed to cycling conditions, even if such electrodes exhibit relatively modest performance at beginning of life compared to premium materials. The electrodes may advantageously comprise materials that contain no precious group metals or rare earth metals. For example, nickel-based alloys, stainless steel variants, transition metal compounds such as iron-cobalt-manganese oxides, or carbon-based materials including graphite composites may be employed instead of conventional precious group metals such as platinum, iridium, or ruthenium, or rare earth metals. Thus, some embodiments of the present application include electrolyzer cells having electrodes (and in particular anode electrodes) designed to provide a low voltage decay rate when exposed to a high number of voltage cycles. Such cells may exhibit a relatively poor performance at beginning of life as compared with precious metal electrodes but also exhibit excellent lifetime under cyclic voltage conditions as compared to precious metal electrodes.

It is to be understood that both the foregoing general descriptions and the following detailed descriptions are exemplary and explanatory only and not restrictive of the disclosure, as claimed. Further objects, features, and advantages of the present application will become apparent from the detailed description of preferred embodiments which is set forth below, when considered together with the figures provided.

BRIEF DESCRIPTION OF DRAWINGS

The accompanying drawings are incorporated into and constitute a part of this specification. The drawings illustrate certain embodiments only of the present disclosure and, together with the foregoing and following descriptions, explain the principles of the disclosure. Wherever possible the same identification numbers have been used to indicate common or like components across different figures.

DETAILED DESCRIPTION OF DRAWINGS

Figure 1:
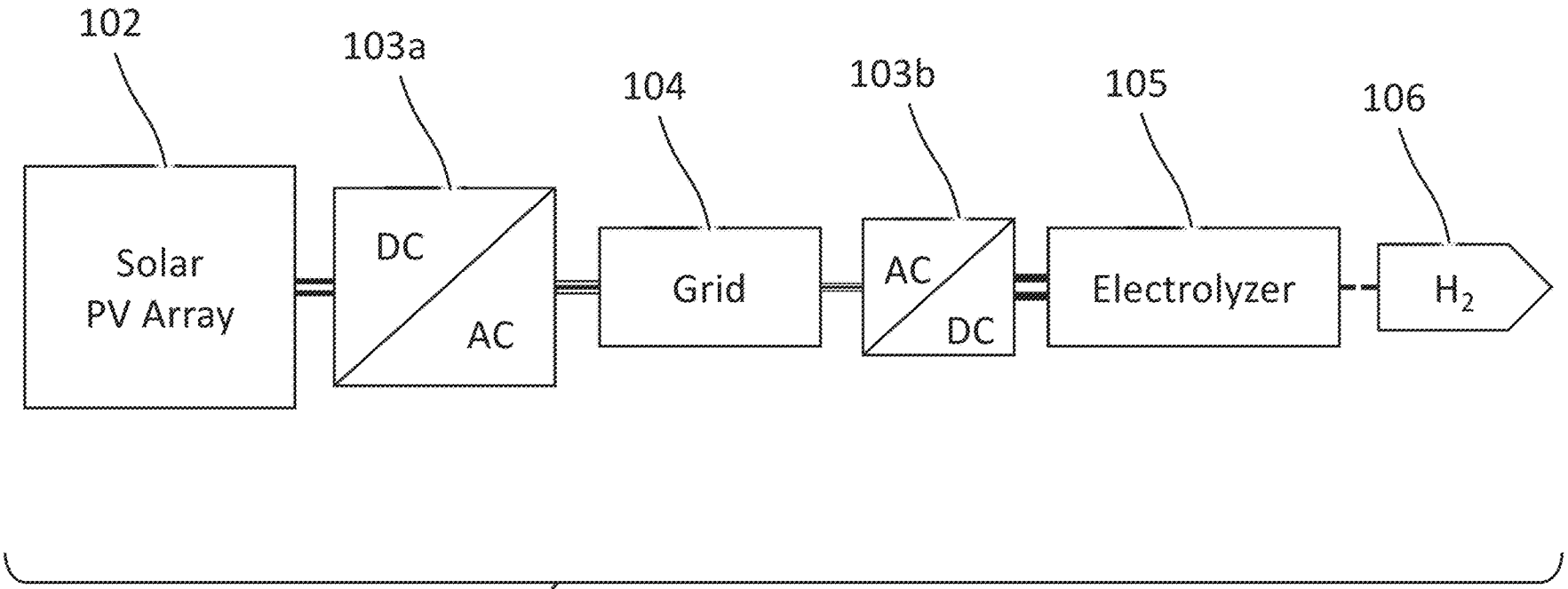
FIGURE 1 Prior art
FIG. 1 shows schematic for a prior art solar electrolysis system wherein the electrolyzer is connected to the grid.

Detailed descriptions of several preferred embodiments will now be given in reference to the accompanying drawings. Although descriptions relate to water electrolysis, it is understood that the described features, components, and methods are applicable and adaptable, by those skilled in the art, to other electrochemical technologies including reduction of carbon dioxide into carbon monoxide, ethylene, or ethylene glycol, the reduction of nitrogen into ammonia or associated compounds, the formation of hydrogen peroxide from water and oxygen or the extraction of lithium from lithium brine solutions, and hydrogen compressors.

Definitions

For convenience we may define a cartesian coordinate system with perpendicular x-y-z axes where "x" is parallel to the general direction of water flow through an electrolysis cell, "y" is perpendicular to x, but in the same plane defined by a single electrolysis cell, and "z" is generally parallel to the direction of stacking of the cells.

As used herein, the singular forms "a", "an", and "the" include plural references unless indicated otherwise. It is noted that in this disclosure, terms such as "comprises," "comprised," "comprising," "contains," "containing" and the like can have the meaning attributed to them in U.S. patent law; e.g., they can mean "includes," "included," "including" and the like. Terms such as "consisting essentially of" and "consists essentially of" have the meaning attributed to them in U.S. patent law, e.g., they allow for the inclusion of additional features or steps that do not detract from the novel or basic characteristics of the invention, i.e., they exclude additional unrecited features or steps that detract from the novel or basic characteristics of the invention. The terms "consists of" and "consisting of" have the meaning ascribed to them in U.S. patent law; namely, that these terms are closed ended. Accordingly, these terms refer to the inclusion of a particular feature or step and the exclusion of all other features or steps.

The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a value is close to a targeted value, where close can mean, for example, the value is within 80% of the targeted value, within 85% of the targeted value, within 90% of the targeted value, within 95% of the targeted value, or within 99% of the targeted value.

The term "ISO container" or "standard ISO container" means a shipping container measuring approximately 8 feet, 6 inches in height, 8 feet in width, and having a length of 10, 20, 24, 28, 40, 44, 45, 46, 53, or 56 feet in length. If not specified, the length of an "ISO container" or "standard ISO container" under discussion or recited in a claim shall be 40 feet or less.

The term "group" means a series of individual electrochemical cells connected in electrical series to achieve a desired input rated voltage range. A group may be created by wiring individual stack units in electrical series.

The term "stack unit" means a single set of individual electrochemical cells contained between a pair of end units such as fluid manifolds and compression plates.

In a network of stack units, the term "branch" means one or more stack units wired in electrical series. In a network of stack units containing a plurality of branches, each branch having the same number of stack units, the term "bank" refers to all stack units that occupy the same relative position within their respective branches. For example, in a network in which each branch contains two stack units, all of the stack units directly connected to a positive buss bar would comprise a first bank, and all of the stack units directly connected to a negative buss bar would comprise the second bank.

In the context of this application, the terms "wire", "wiring", "wired", "bus", and the like are used to connote a low impedance (less than 10 milliohms, preferably less than 1 milliohm, most preferably less than 100 microohms) electrical connection between two components. Accordingly, these terms should be read to encompass any conductor or plurality of conductors capable of making such low impedance electrical connection, including (but not limited to) clad and unclad physical wires and metal strips or bars.

The term "rated" refers to the design value specified by the manufacturer, or, if no value has been specified, the value actually observed under normal operation. Normal operation is the operation of a device as would be undertaken by a person having an ordinary level of skill in the art.

The term "photovoltaic" or "PV" refers to a device made to convert light energy in the form of photons directly into DC electrical energy in the form of electrons.

The term "panel" refers to a planar, unitized array of individual solar cells wired in a series-parallel network to achieve a specified output voltage and current when exposed to sunlight of a given irradiance.

The term "irradiance" refers to the intensity of light energy falling on a planar surface, which may be measured in watts per square centimeter [$W/cm^2$] or other appropriate units.

The term "string" refers to two or more solar PV panels wired in series to achieve a specified output DC voltage.

The term "field" refers to one or more strings wired in parallel to deliver a specified DC current to an electrical bus.

The term "solar PV system" or "solar PV array" refers to one or more fields wired in parallel to deliver a specified DC current to an electrical bus.

The term "maximum power point" or "MPP" refers to the specific operating voltage and current for a panel that achieves the maximum output power (voltage times current) for a given solar irradiance provided to the panel.

The term "shunt current" refers to undesirable electrical currents flowing between cells, terminal plates, manifolds, or plumbing connections in an electrolyzer due to conductive transport of electrons and/or ions in the liquid flowing to and through the stack.

The term "pitch" refers to the effective, average thickness of an individual cell in an electrolyzer stack, which may be calculated by dividing the total length of the stack core (i.e., length of all the cells along a z-axis in the stack) by the number of cells in the stack.

The term "matched" refers to the process of selecting a source polarization characteristic (SPC) for a solar PV system that is compatible with and/or optimized for connection to an electrolyzer system's impedance polarization characteristic (IPC). See FIG. 8 for examples of an SPC and IPC for a preferred embodiment.

The term "natural operating point" refers to the instantaneous operating voltage and current that a direct DC solar-hydrogen system, as described herein, exhibits when exposed to a specified solar irradiance without employing active voltage or current controls between the solar system and electrolyzer system.

The term "active" voltage, current, or power management devices refers to devices that dynamically control, regulate, or convert electrical parameters in response to changing conditions, and specifically excludes passive components such as resistors, capacitors, and inductors that provide fixed electrical characteristics without feedback control or switching operation.

DETAILED DESCRIPTIONS

FIG. 1 illustrates a prior art solar-hydrogen system (101) wherein a solar PV system (102) is connected to the electrical grid (104) through a DC-to-AC converter (103*a*). Electrical energy from the grid is then delivered to an AC-to-DC converter (103*b*) which converts the electricity from alternating to direct current and conditions the power at the correct voltage and current to connect to an electrolyzer system (105). The electrolyzer system (105) then uses the provided DC electricity to split water molecules into constituent hydrogen and oxygen molecules wherein the electrical energy is stored in chemical energy in the form of hydrogen (106). This system may have the advantage of being able to deliver solar PV energy long distances over an efficient AC electrical grid. It may also have the advantage of being able to provide relatively constant power to the electrolyzer system for electrolyzers that require clean, steady power. However, it may have many limitations including: 1) multiple power conversion steps (103*a*, 103*b*) resulting in energy losses; 2) the need for proximity to and approval for connection to the grid (104), which may result in tie-in fees and/or permitting or approval delays; 3) reliability issues, and capital and maintenance costs associated with electrical power conversion equipment (103*a*, 103*b*); 4) Additional real estate and tax costs associated with land more valuable due to proximity to the grid; 5) major grid connection delays due to the need for local grid equipment upgrades required to handle the addition of variable solar PV power; 6) the need for and costs of managing solar RECs for transacting generated renewable energy with green hydrogen producers connected to the grid.

Figure 2:
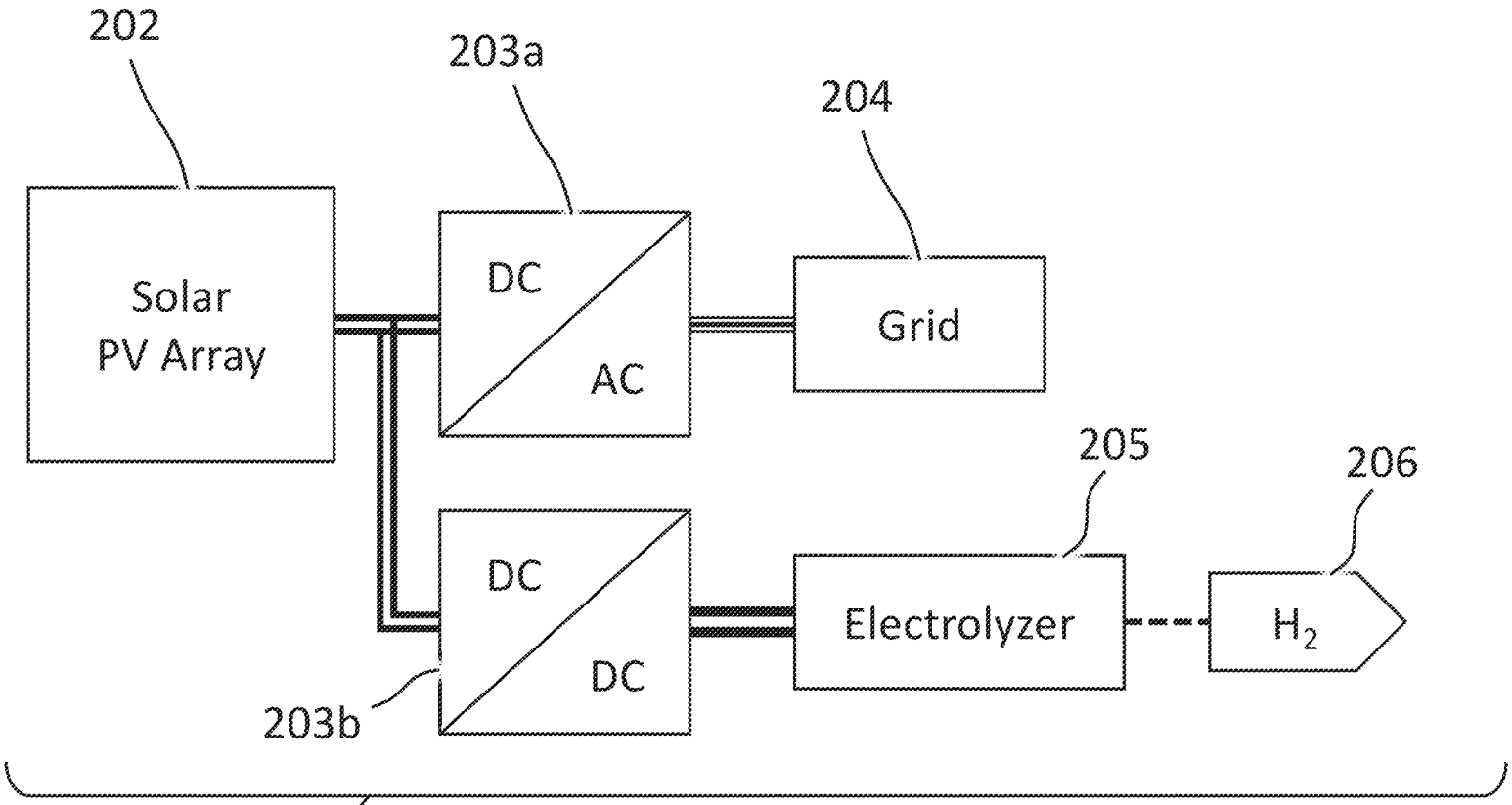
FIGURE 2 Prior art
FIG. 2 shows schematic for a prior art solar electrolysis system wherein the electrolyzer is connected to the DC bus of a grid-connected solar array through a DC-DC power regulation system.

FIG. 2 illustrates a prior art solar-hydrogen system (201) wherein a solar PV system (202) is connected to the electrical grid (204) through a DC-to-AC converter (203*a*). A DC-to-DC power converter (203*b*) takes DC electricity directly from the solar PV system and conditions it (i.e., controls the voltage, current, and quality) for delivery to an electrolyzer system (205). The electrolyzer system (205) then uses the provided DC electricity to split water molecules into constituent hydrogen and oxygen molecules wherein the electrical energy is stored in chemical energy in the form of hydrogen (206). This system may have the advantage of avoiding the need to manage RECs as the electrolyzer system (205) is directly connected to the renewable solar PV system (202). However, it may have many limitations including: 1) multiple power conversion steps (203*a*, 203*b*) resulting in energy losses; 2) the need for proximity to and approval for connection to the grid (204), which may result in tie-in fees and/or permitting or approval delays; 3) reliability issues, and capital and maintenance costs associated with electrical power conversion equipment (203*a*, 203*b*); 4) Additional real estate and tax costs associated with land more valuable due to proximity to the grid (204); 5) major grid connection delays due to the need for local grid equipment upgrades required to handle the addition of variable solar PV power; 6) the conditioning step (203*b*) may involve stepping down the voltage and stepping up the current to match an electrolyzer system with a large active area and a small number of cells stacked in series. This "high current" DC-DC power conversion system (203*b*) may not be commonly available on the market, making it a custom design, built at low production volumes and driving additional capital and construction costs.

Figure 3A:
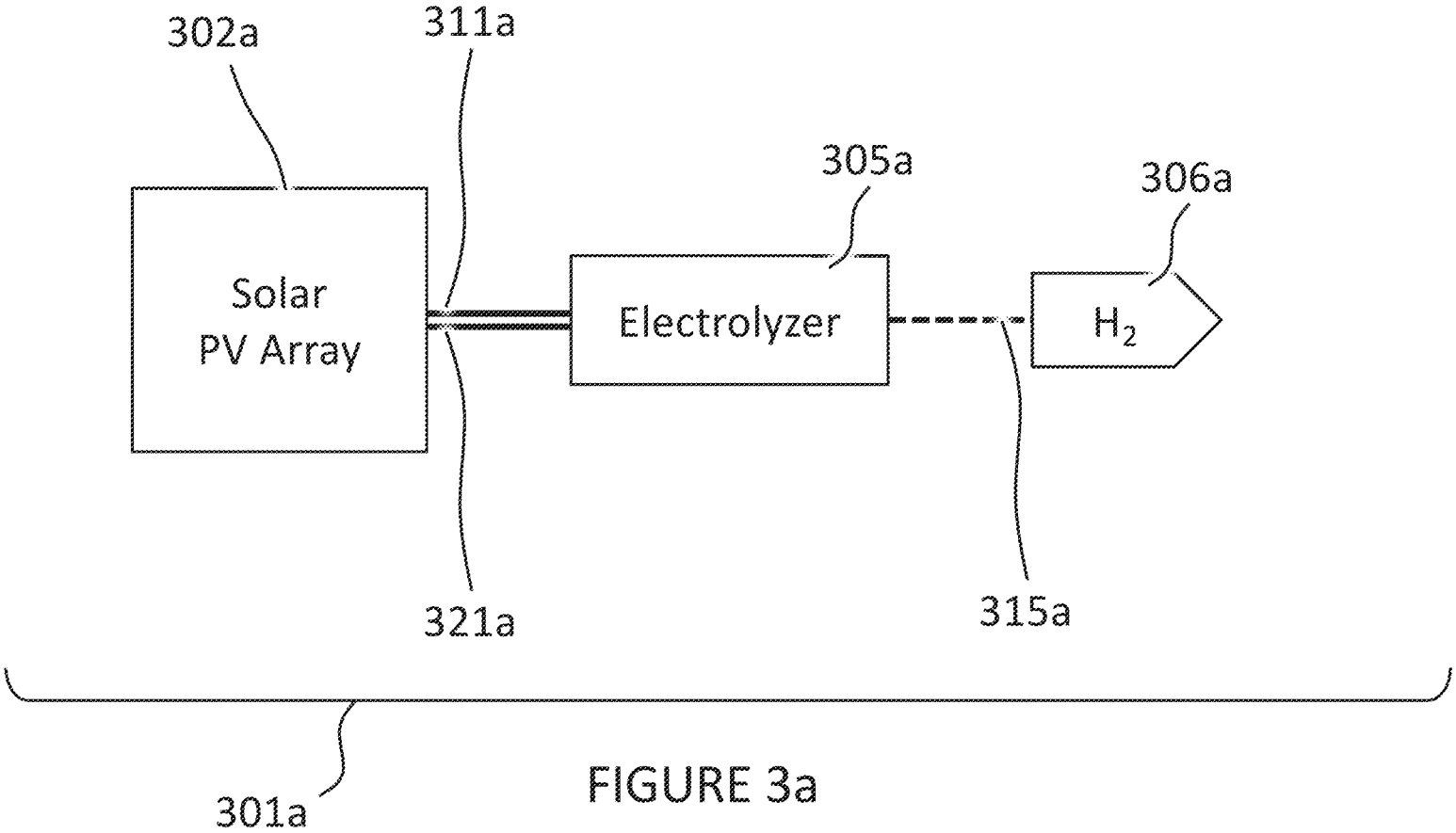
FIG. 3*a* shows a preferred embodiment of the present disclosure wherein the electrolyzer is connected directly to the unregulated DC bus of the solar system.

FIG. 3*a* illustrates a preferred embodiment of the present disclosure (301*a*) wherein a solar PV system (302*a*) is directly connected through a positive bus (311*a*) and a negative bus (321*a*) to an electrolyzer system (305*a*). The electrolyzer system (305*a*) then uses the provided DC electricity to split water molecules into constituent hydrogen and oxygen molecules wherein the electrical energy is stored in chemical energy in the form of hydrogen (306*a*) that may be delivered to downstream user via a pipe (315*a*) or via other delivery approaches (not pictured). To operate effectively without power conversion devices, system (301*a*) may need to be configured with a solar PV system (302*a*) whose rated output voltage and current (i.e., source polarization characteristic, SPC) is matched to the rated input voltage and current (i.e., impedance polarization characteristic, IPC) of the electrolyzer system (305*a*). For safety and operability reasons, switches (not shown) may need to be included at various points in the solar PV system (302*a*) and/or the electrolyzer system (305A), but these need only be on/off devices providing no voltage, current, or power conversion functions. This system overcomes all limitations described for prior art systems (101) and (201) above.

Figure 3B:
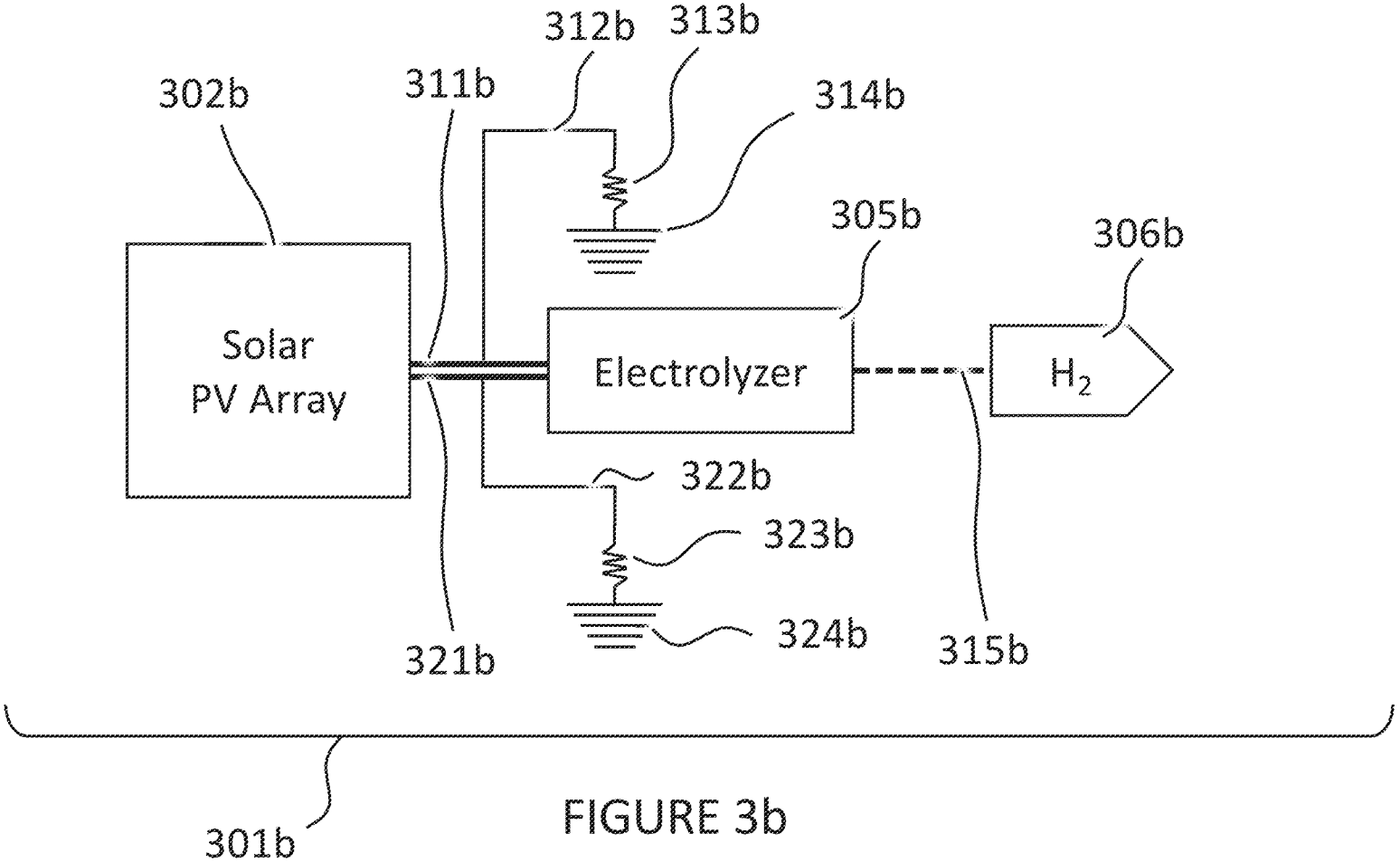
FIG. 3*b* shows a preferred embodiment of the present disclosure wherein the electrolyzer is connected directly to the unregulated DC bus of the solar system and the positive and negative buses are equally earth-ground referenced to achieve positive and negative values symmetrically centered around zero volts relative to earth ground.

FIG. 3*b* illustrates a preferred embodiment of the present disclosure (301*b*) which is identical to (301*a*) but with the addition of earth-ground reference resistors (313*b*, 323*b*) to the positive bus (311*b*) and negative bus (321*b*), respectively. In this configuration, the positive bus (311*b*) and negative bus (321*b*) may be held at a positive and negative voltage, relative to earth ground, of nearly equal absolute value. For instance, if the overall voltage of the solar PV system (302*b*) is 1,500 VDC, the resistors (313*b*, 323*b*) may shift the voltages of buses (311*b* and 321*b*) to be +750 VDC and −750 VDC, respectively. This configuration may provide advantages for limiting shunt currents for certain configurations of an electrolyzer module as described in FIGS. 7*a* and 7*b*.

Figure 4:
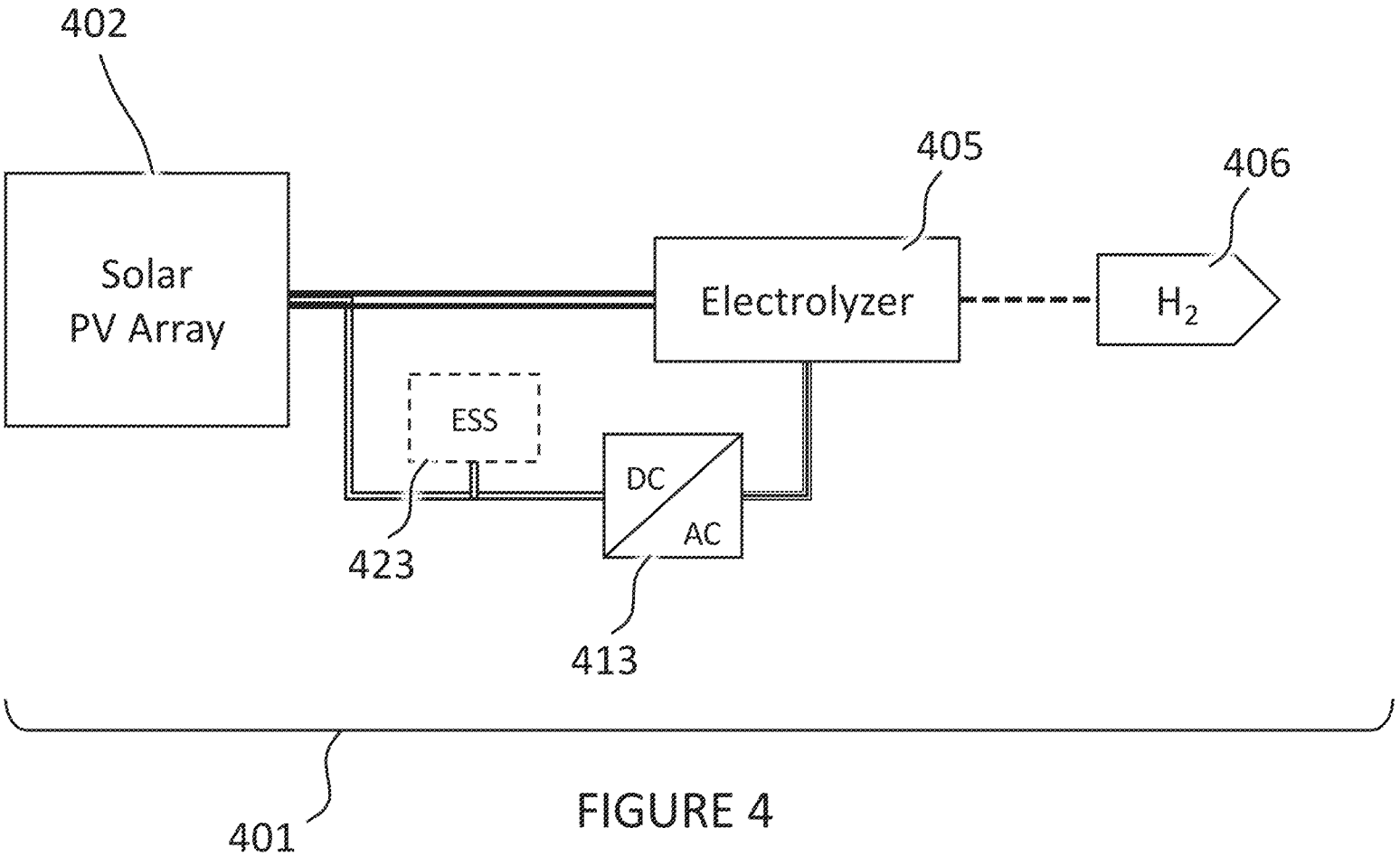
FIG. 4 shows a preferred embodiment of the present disclosure wherein the electrolyzer is connected directly to the unregulated DC bus of the solar system and a small DC-AC converter is employed to provide AC electrical power to the electrolysis system directly from the same unregulated DC bus.

FIG. 4 illustrates a preferred embodiment of the present disclosure (401) which is identical to (301*a*) but with the addition of a DC-to-AC conversion system (413) and an optional energy storage system, "ESS" (423) for providing a small quantity of AC electricity to the electrolyzer system (405), if necessary. It may be typical for the balance of plant of an electrolyzer system to operate with equipment requiring AC electricity, and the shown DC-AC converter (413) may be configured for this purpose using, as an input, power from the solar PV system (402). It may also be advantageous to store a small amount of energy in an energy storage system, "ESS" (423) for use when the production of the solar PV system is unavailable or low. This configuration may be particularly useful during start up in the morning, before the sun rises and/or for shutdown in the evening, as the sun sets. The optional ESS may also provide advantages during periods of little to no sunlight (nighttime, bad weather) for keeping the electrolyzer system from freezing in cold weather.

Figure 5:
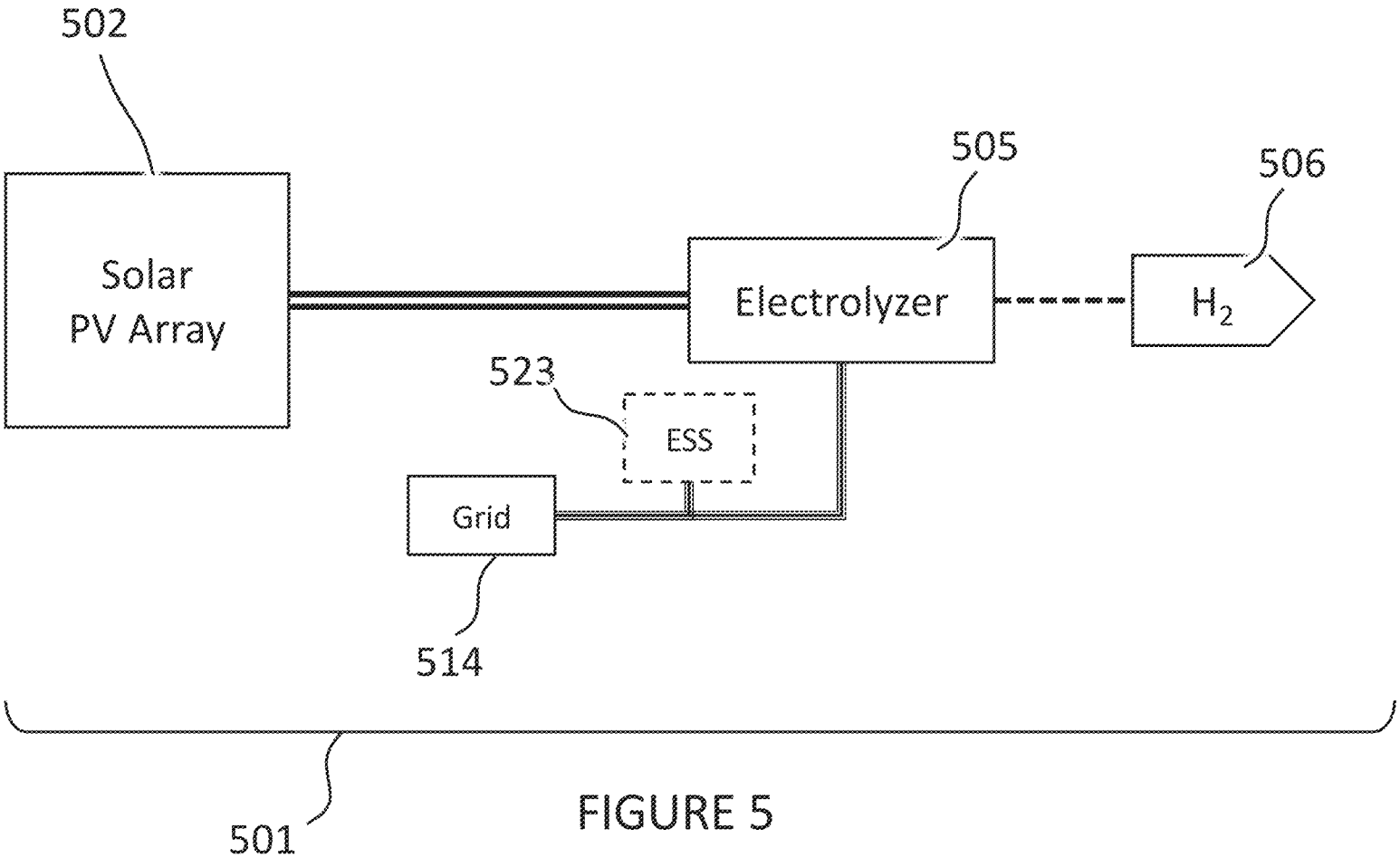
FIG. 5 shows a preferred embodiment of the present disclosure wherein the electrolyzer is connected directly to the unregulated DC bus of the solar system and AC electrical power for the electrolysis system comes from the grid.

FIG. 5 illustrates a preferred embodiment of the present disclosure (501) which is identical to (301*a*) but with the addition of a grid connected, AC supply system (514) and an optional energy storage system, "ESS" (524) for providing a small quantity of AC electricity to the electrolyzer system (505), if necessary. It may be typical for the balance of plant of an electrolyzer system to operate with equipment requiring AC electricity, and the AC grid connection (514) may be configured for this purpose. It may also be advantageous to store a small amount of energy in an energy storage system, "ESS" (523) for backup in cases where grid power goes out to ensure that the electrolyzer system does not freeze in cold weather.

Figure 6:
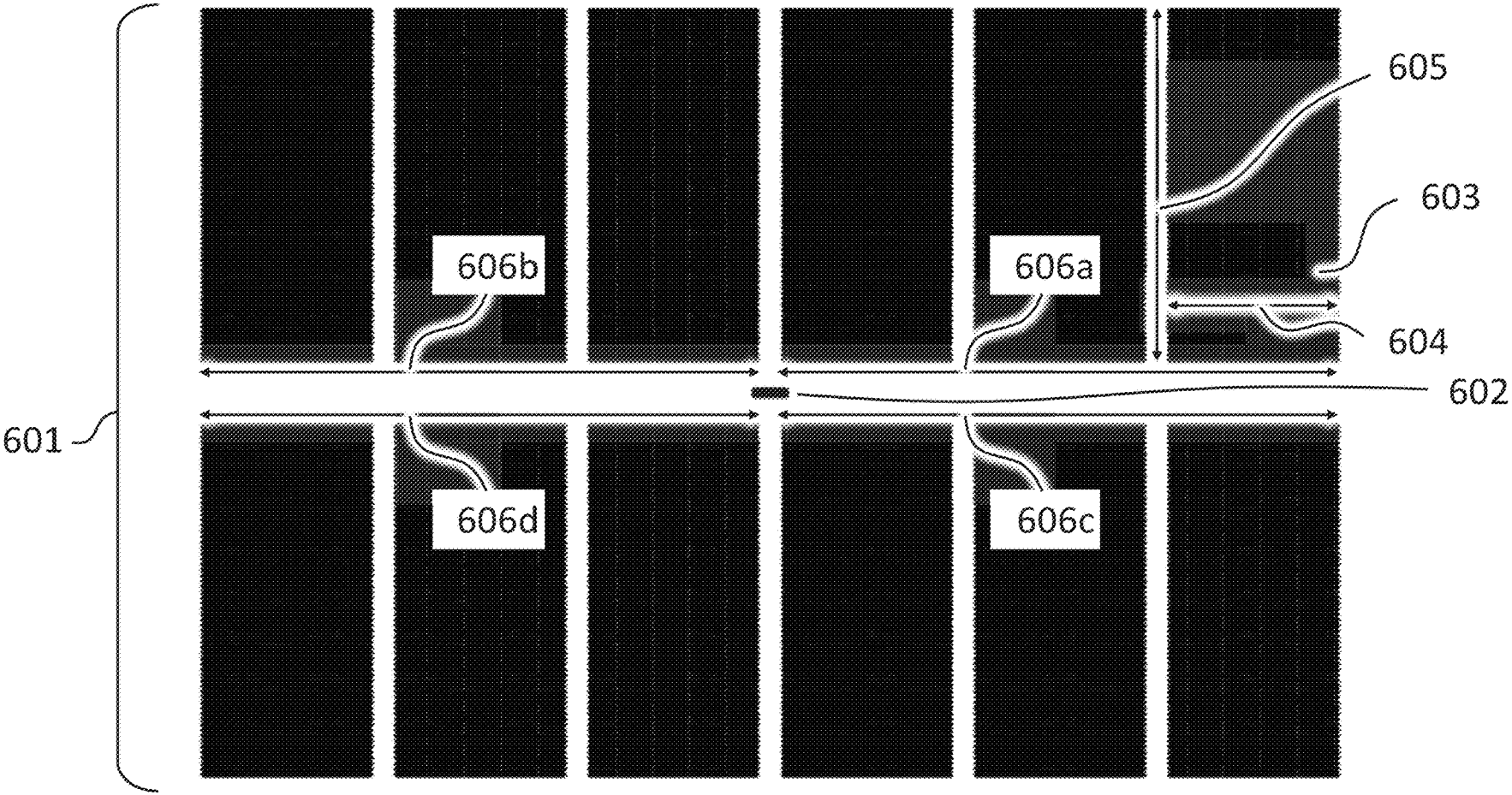
FIG. 6 shows a top-down, plan view of a preferred embodiment of the present disclosure illustrating the relative footprint of a solar PV system and an electrolyzer stack module with a peak power potential of approximately 9 megawatts.
Figure 8:
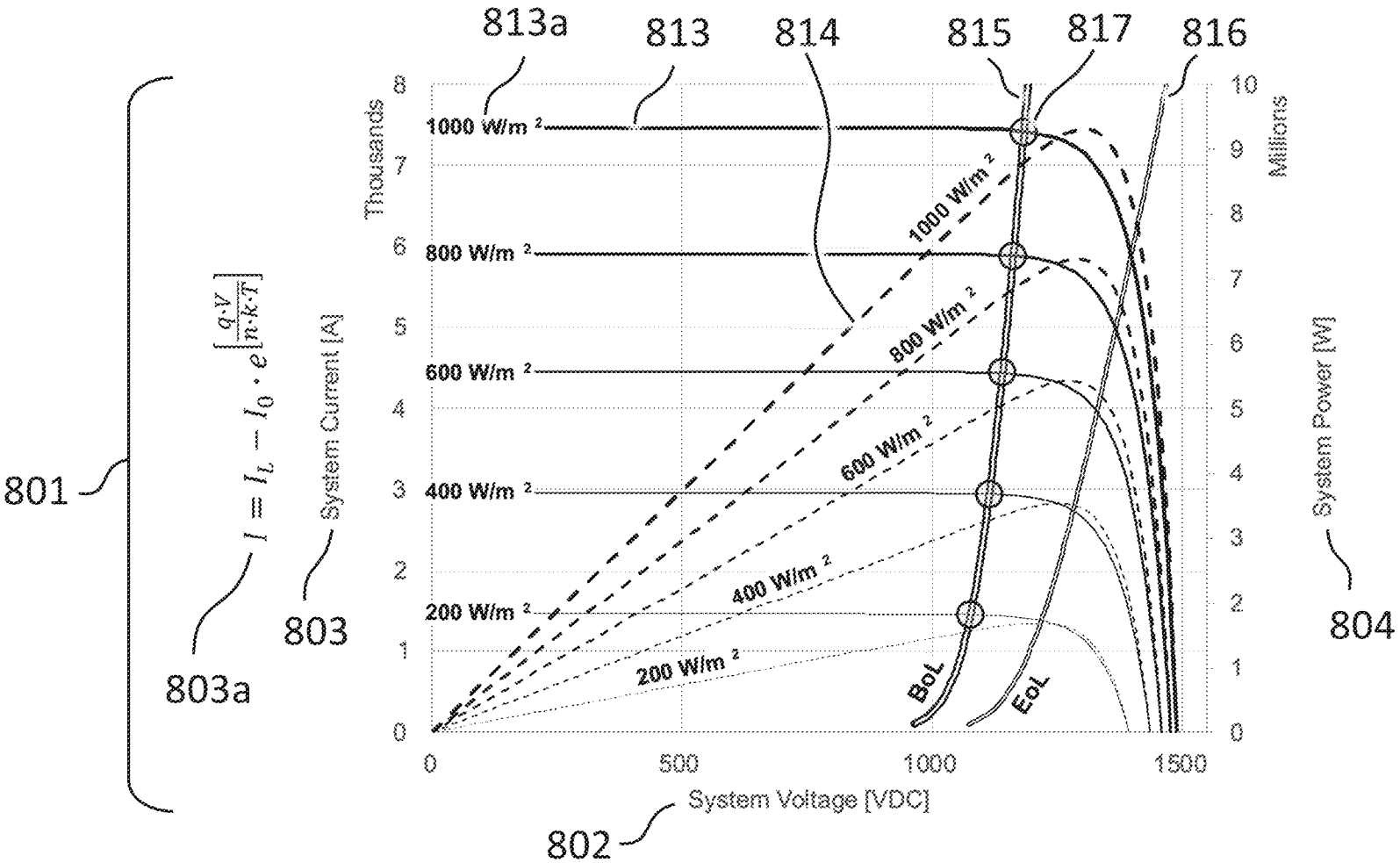
FIG. 8 shows a graph overlaying the impedance polarization characteristic (IPC) curve for a preferred embodiment electrolysis system with the source polarization (SPC) curve for a preferred embodiment solar PV system illustrating the natural operating points of the resulting network as a function of solar irradiance.

FIG. 6 illustrates a top-down, plan view of a preferred embodiment solar-hydrogen system (601) comprising 1 electrolyzer stack module (602) and 12 solar PV fields (603). The electrolyzer stack module may comprise 24 individual electrolyzer stack units, each comprising 324 electrolyzer cells wired in series as pairs to form 12 individual groups or "branches", with each branch wired in parallel to establish an IPC curve as illustrated in FIG. 8. Twelve solar PV fields (603) may be arranged with 37 panels wired in series along a direction (604) to create strings with a given bus voltage, and 64 strings wired in parallel along a direction (605), comprising a total of 28,416 panels, to provide a total current to an electrical bus for the field (603) equal to the sum of the current from each string. The buses (605) from each field may then be connected to buses (606*a*→606*d*), each carrying a current equal to the sum of the current from the fields (603) to which they are connected, for delivery of the DC electricity from the entire solar PV system (as shown, 12 times 603) to the electrolyzer stack module (602). Various arrangements of such a system are possible and may be designed to optimize certain operational parameters such as wiring/bus network cost. Switches (not shown) may be included in the bus network at various locations to ensure safety and/or enhance functionality of the SPC-IPC matching for the solar-hydrogen system (601). For the embodiment shown in FIG. 6, the number of panels in each string may be selected to achieve a maximum rated voltage for the solar PV system of 1,000 VDC, 1,500 VDC, 2,000 VDC, or 3,000 VDC, and may be selected based on the rating of commercially available solar PV system components. The number of strings in each field (603) and fields in the system (601) may be selected to achieve a specified total power for the solar PV system. The number of electrolyzer cells connected in series within electrolyzer stack module (602) may then be selected to match the rated voltage of the selected solar PV system string. The number of electrolyzer cell groups wired in parallel may then be selected to provide a rating for the electrolyzer stack module compatible with the maximum expected total current available from the solar PV system (as shown, 12 times 603). In this way, the combination of the solar PV system wiring network and the electrolyzer stack module wiring network may be selected to provide a matched SPC-IPC for the overall system, as illustrated in FIG. 8.

Figure 7A:
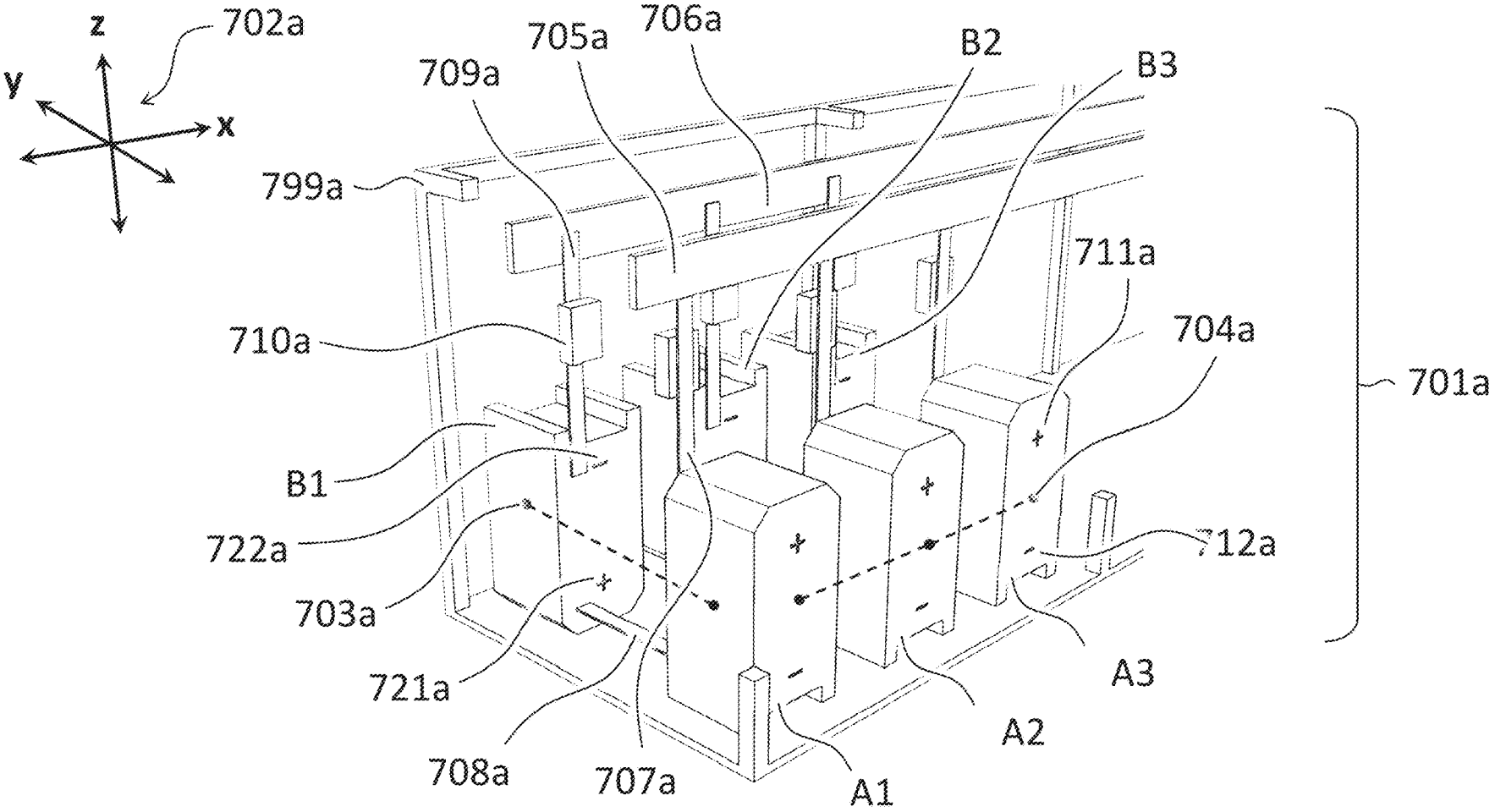
FIG. 7*a* shows a preferred embodiment electrolyzer stack module comprising 6 stacks arranged with 3 branches and 2 banks.

FIG. 7*a* illustrates a multi-stack electrolyzer module (701*a*) comprising six individual stack units (A1, A2, A3, B1, B2, B3) within an exemplary container (799*a*). Coordinate system (702*a*) is shown for convenience of description with an x-axis aligned with a long dimension of container (799*a*), a y-axis aligned with a short dimension of container (799*a*), and a z-axis aligned with the height dimension of container (799*a*). Stack units are arranged in pairs comprising branches (703*a*) and a series of branches comprising banks (704*a*). In this configuration, each branch comprises a group of cells. Bank "A" comprises stacks (A1, A2, A3) while bank "B" comprises stacks (B1, B2, B3). The stack units in bank A are oriented along the z-axis (702*a*) with their positive terminal (711*a*) up and negative terminals (712*a*) down. The stack units in bank B are oriented along the z-axis (702*a*) with their positive terminal (721*a*) down and negative terminals (722*a*) up. This arrangement is optional and minimizes the length of the wiring connection (708*a*) between the stacks in each branch compared to having all stacks in the same orientation. The stacks in each branch (A1-B1, A2-B2, A3-B3) are wired in series with the positive terminal of the A-bank stacks (711*a*) connected to the positive module bus bar (705*a*), and the negative terminal of the B-bank stacks (722*a*) connected to the negative module bus bar (706*a*). The negative terminals of the A-bank stacks are connected to the corresponding positive terminals of the B-bank stacks with interconnect wiring (708*a*) to form a series-circuit along the y-axis direction of the module. Connections (709*a*) of each bank of stacks to the positive (705*a*) and negative (706*a*) bus bars results in electricity being provided in parallel to each of the three branches. Optional current measurement and DC disconnect devices (710*a*) are provided on each of the 6 stack connections (709*a*) to enable individual branches to be monitored for current draw and disconnected, if necessary, without shutting the module completely down or stopping water flow to any stack unit.

Figure 7B:
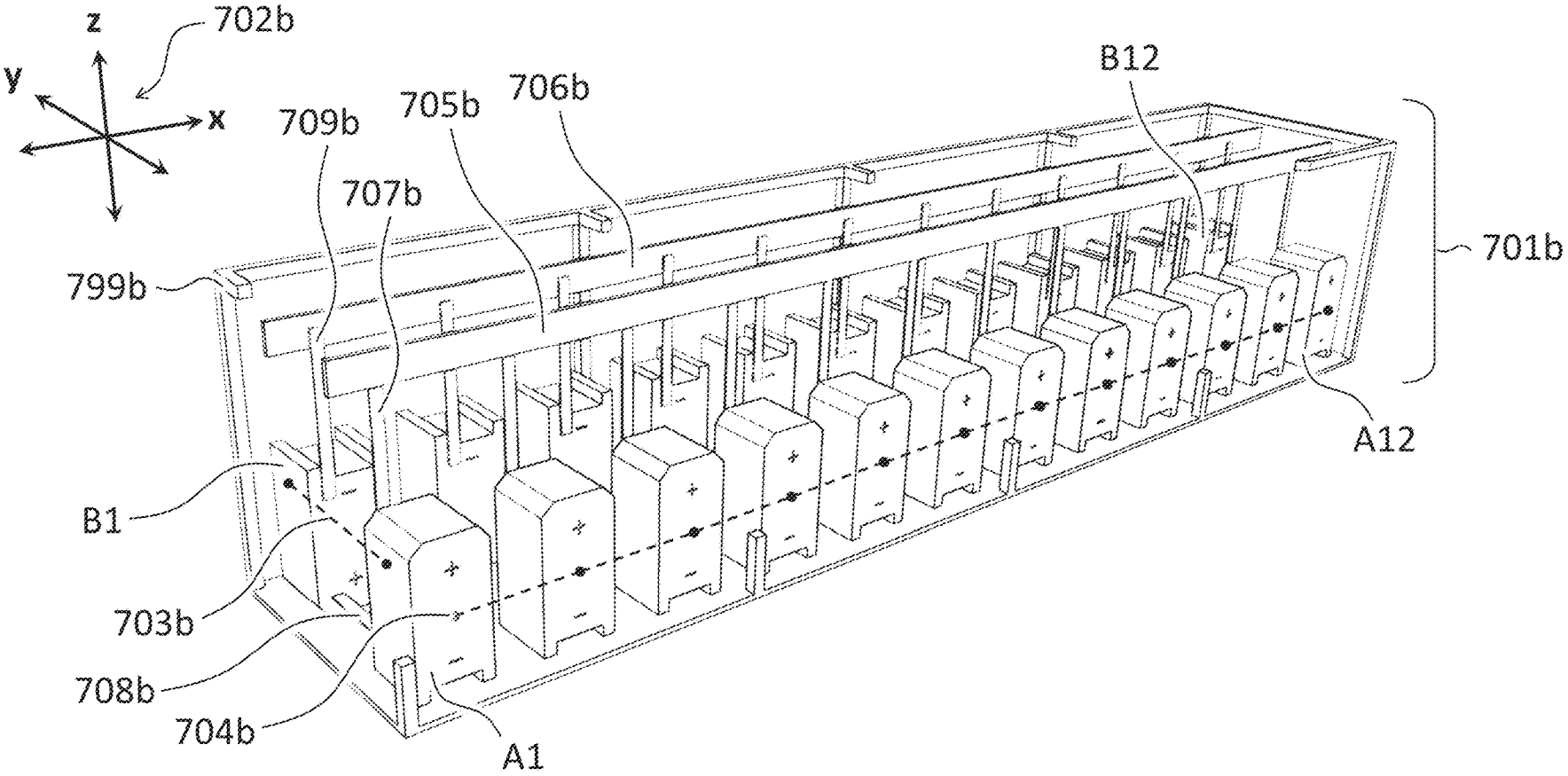
FIG. 7*b* shows a preferred embodiment electrolyzer stack module comprising 24 stacks arranged with 12 branches and 2 banks.

FIG. 7*b* illustrates a multi-stack electrolyzer module (701*b*) comprising twenty-four individual stack units (A1→A12, B1→B12) within an exemplary container (799*b*). Coordinate system (702*b*) is shown for convenience of description with an x-axis aligned with a long dimension of container (799*b*), a y-axis aligned with a short dimension of container (799*b*), and a z-axis aligned with the height dimension of container (799*b*). The module of FIG. 7*b* is analogous to the module of FIG. 7*a* with the addition of a greater number of paired stack branches wired in parallel to bus bars (705*b*) and (706*b*), thereby demonstrating the scalability of the series-parallel scheme as disclosed. The pair-wise scheme shown can conceivably be implemented for any even number of stack units greater than four. For instance, 4 stacks total (2-series×2-parallel), 6 stacks total (2-series×3-parallel), 12 stacks total (2-series×6-parallel), 24 stacks total (2-series×12-parallel), or 48 stacks total (2-series×24-parallel). It should be understood, of course, that configurations having more than 2 units in series (e.g. 3, 4, or more stack units per branch) are also within the scope of this application. In matching the IPC of module (701*b*) with the SPC of a solar PV system, the total number of cells in each branch may be selected based on the output voltage rating of the solar PV system. For instance, branch cell count may be selected to match the solar system rated voltage at the beginning of life for the electrolyzer cells, the end of life for the electrolyzer cells, or at a selected life midpoint for the electrolyzer cells. Alternately, branch cell count may be selected to match the solar system maximum power point (MPP) voltage at the beginning of life for the electrolyzer cells, the end of life for the electrolyzer cells, or at a selected life midpoint for the electrolyzer cells. The chosen branch cell count may further be optimized to account for aging of the electrolyzer cells, solar cells, or both, in order to maximize the total daily hydrogen capacity, the total lifetime hydrogen production, to minimize the lifetime levelized cost of hydrogen, of some combination of these operating metrics.

FIG. 8 illustrates (801) an exemplary matching of SPC and IPC curves for the solar PV system and electrolyzer module as configured in FIG. 6. The SPC for the solar PV system comprises voltage (802) vs. current (803) characteristics as depicted with exemplary curves (813) at various irradiance values (813*a*). Theoretical performance equation (803*a*) describes the shape of curves (813) as a function of irradiance (813*a*). As more solar panels are added to a string, voltage may increase, shifting the curves (813) to the right. As more strings and/or fields are wired in parallel, current may increase, shifting curves (813) upward. Power (804) for the solar PV system may be calculated by multiplying voltage by current; power for each of the exemplary curves (813) are shown as curves (814). The IPC for the electrolyzer system comprises voltage (802) vs. current (803) characteristics as depicted with exemplary curves (815) and (816) at the beginning (BoL) and end (EoL) of electrolyzer life, respectively. As more electrolyzer cells are added to a group, curves (815) and (816) may shift to the right. As the active area of each electrolyzer cell and/or the number of branches within the electrolyzer stack module is increased, curves (815) and (816) may shift upward. The points (817) where the IPC cross the SPC represent the natural operating point for the unregulated solar-hydrogen system. This natural operating point may vary as a continuous function of solar irradiance and may change over time as the solar PV panels, electrolyzer cells, or both age. The end of life for the electrolyzer cells may be determined by several operating factors, including 1) a maximum allowable individual cell voltage; 2) an overall voltage rating for the electrolyzer stack module. Hydrogen production rate may be proportional to the power delivered by the solar PV system as depicted by power curves (814). A maximum, instantaneous hydrogen production rate may therefore be realized for a direct DC solar-hydrogen system by configuring the number of cells in each electrolyzer cell group to match the solar PV system voltage at the maximum of the associated power curves (814). However, due to the shape of these power curves (814), as the electrolyzer cells age, production of hydrogen may quickly drop off, following the steep downward slope of curves (814) as the BOL IPC (815) shifts to the right and operating voltage increases, approaching EoL IPC (816). It may therefore be desirable to simulate the combined system production over its lifetime in order to optimize the total hydrogen produced, the total cost of produced hydrogen, or both.

Figure 9:
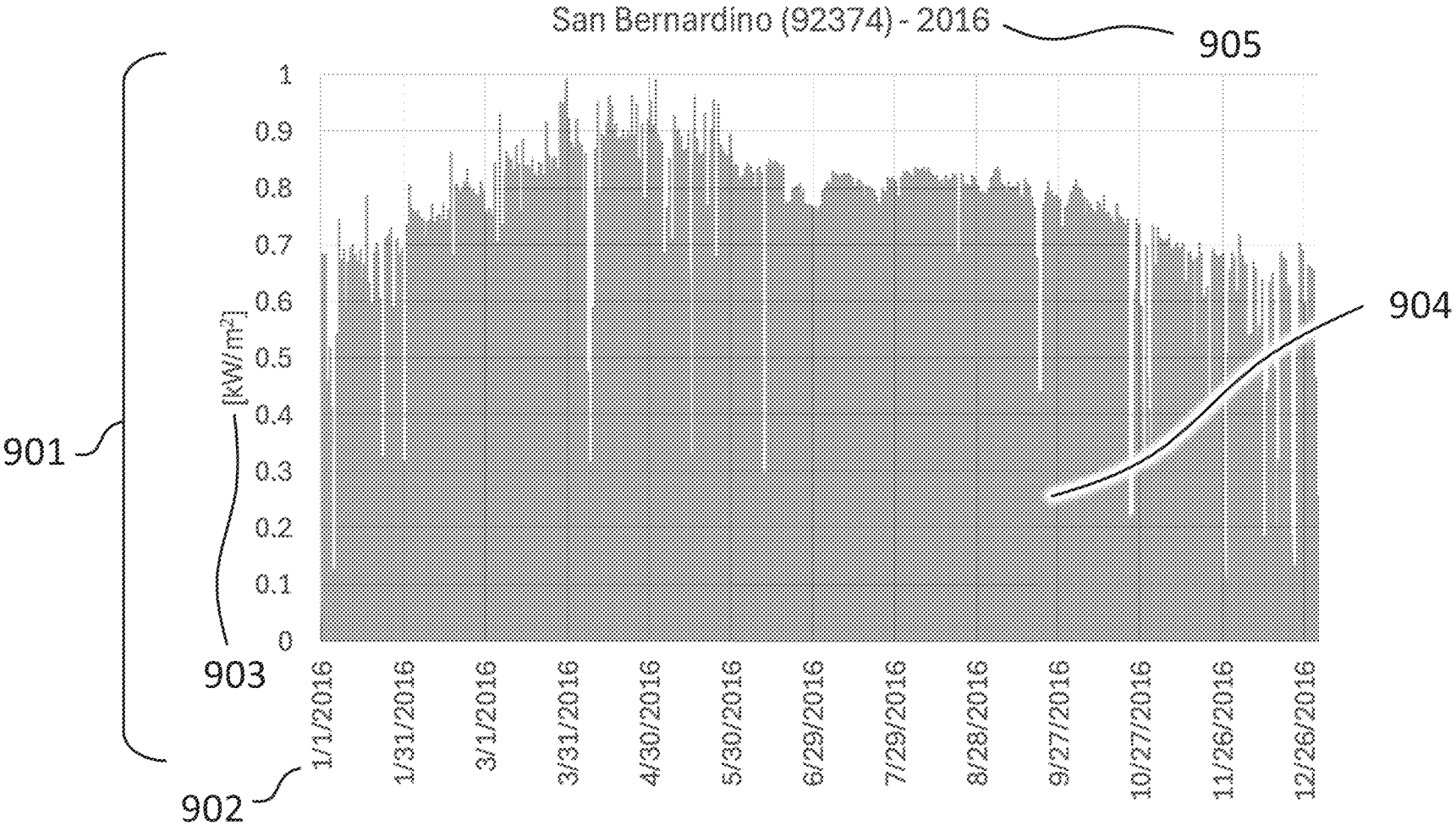
FIG. 9 shows estimated solar irradiance data for the year 2016 in San Bernardino, CA (zip code 92374) acquired from the California Distributed Generation Statistic website (https://www.californiadgstats.ca.gov/downloads/).

FIG. 9 illustrates exemplary solar irradiance data (901) provided by the State of California Distributed Generation Statistic website (https://www.californiadgstats.ca.gov/downloads/) for the year 2016 (902) in San Berardino, CA (905, zip code 92374). This data is a time series of solar irradiance (904) in $kW/m^2$ (903, estimated based on measured output AC power) in 15-minute intervals as recorded from an operating solar plant in San Bernardino. This data was used as an input to a computer model of a system based on the SPC/IPC of FIG. 8 to simulate the real-time hydrogen production of such a system installed at this location.

Figure 10:
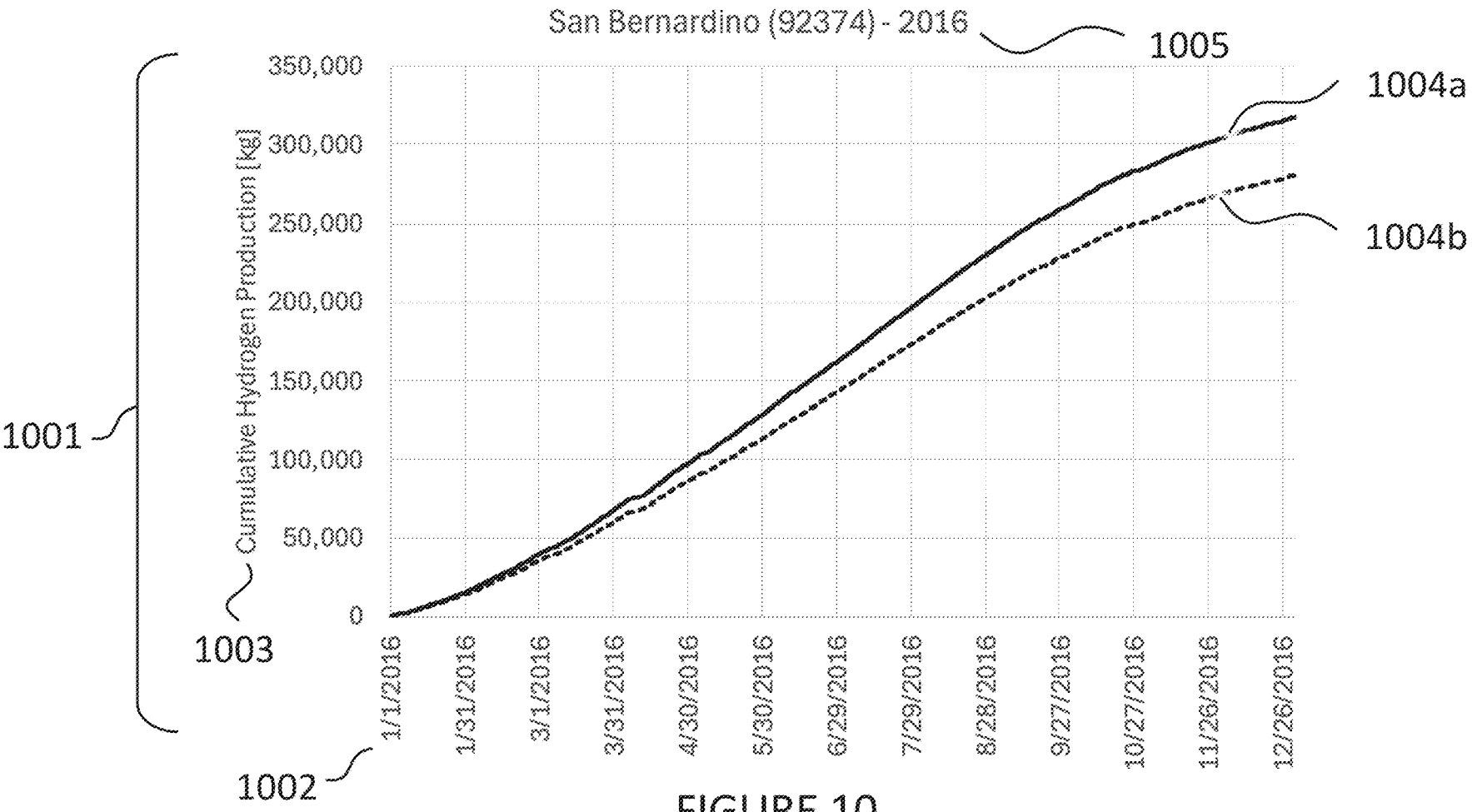
FIG. 10 shows the simulated, annual, cumulative hydrogen production for the electrolyzer module of FIG. 7*b* connected to the solar PV system of FIG. 6 assuming the solar irradiance profile of FIG. 9 calculated assuming either beginning- or end-of-life performance for the electrolyzer.

FIG. 10 illustrates the results (1001) of the simulation described for FIG. 9. Cumulative hydrogen generation (1003) over time (1002) was simulated for a BoL electrolyzer system (1004*a*) and an EoL electrolyzer system (1004*b*) operating in San Bernardino, CA (1005, zip code 92374). These results were then used as an input to an optimization routine, the results of which are described in FIGS. 11 and 12.

Figure 11:
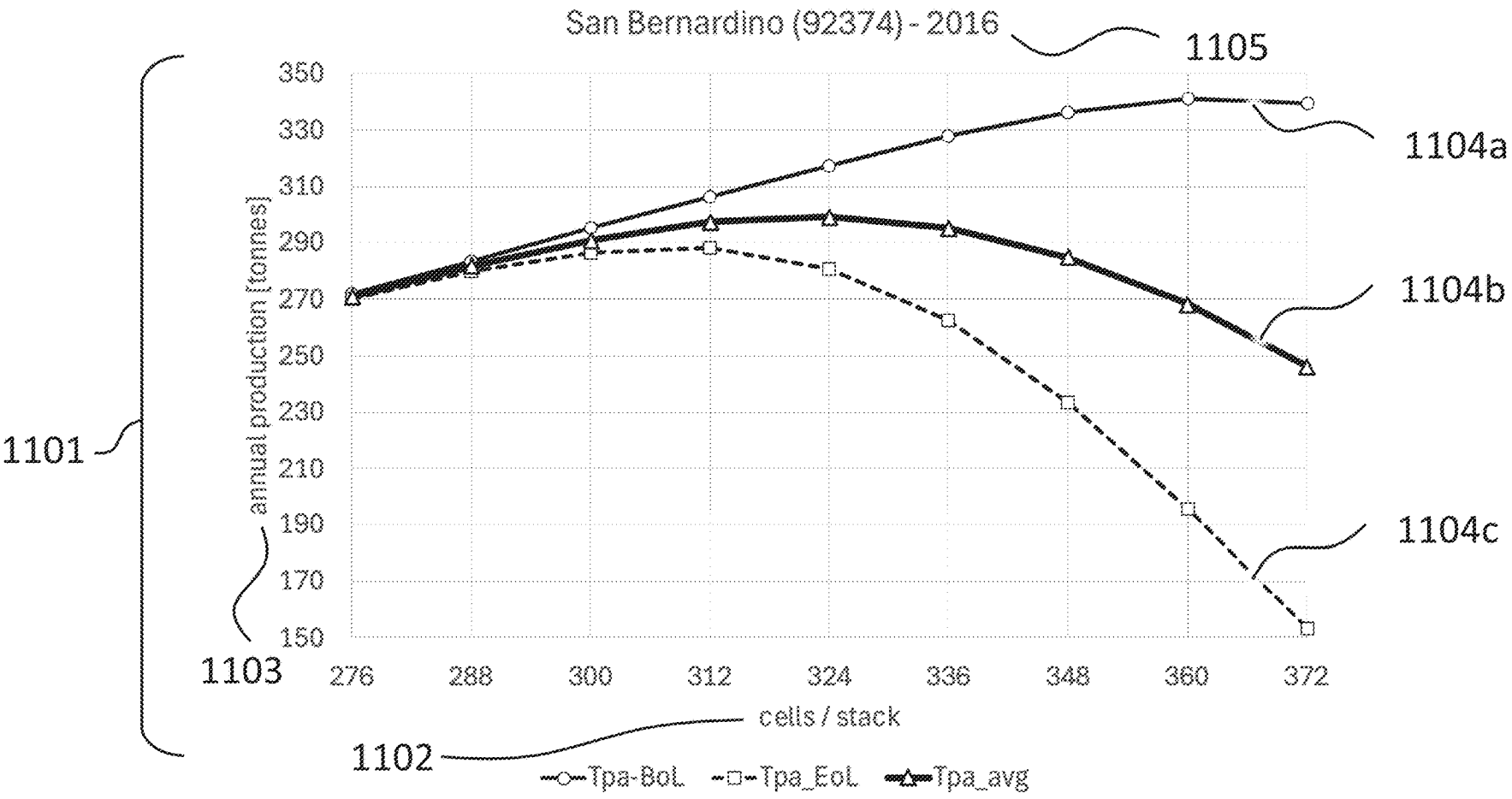
FIG. 11 shows the results of an optimization study for the simulated, annual hydrogen production of FIG. 10 as a function of selected cell count in the stacks of the module.

FIG. 11 illustrates the results of an optimization (1101) for annual hydrogen production (1103) based on the simulation described in FIG. 9. Annual, cumulative hydrogen production for 2016 in San Bernardino, CA (1105) was calculated using the model described in FIG. 9 for stacks with different cell counts (1102). Values based on electrolyzer cells at their BoL (1104*a*) and EoL (1104*c*) performance were calculated, along with the average of these conditions (1104*b*). If the goal is to maximize the first year's hydrogen production capacity for the plant, then the optimum number of cells for each stack in a 2-stack branch may be 360 cells. If the goal is to maximize the last year's hydrogen production capacity for the plant, then the optimum number of cells for each stack in a 2-stack branch may be 312 cells. If the goal is to maximize the average hydrogen production capacity for the plant over its lifetime (i.e., achieve the maximum lifetime hydrogen production capacity), then the optimum number of cells for each stack in a 2-stack branch may be 324 cells.

Figure 12:
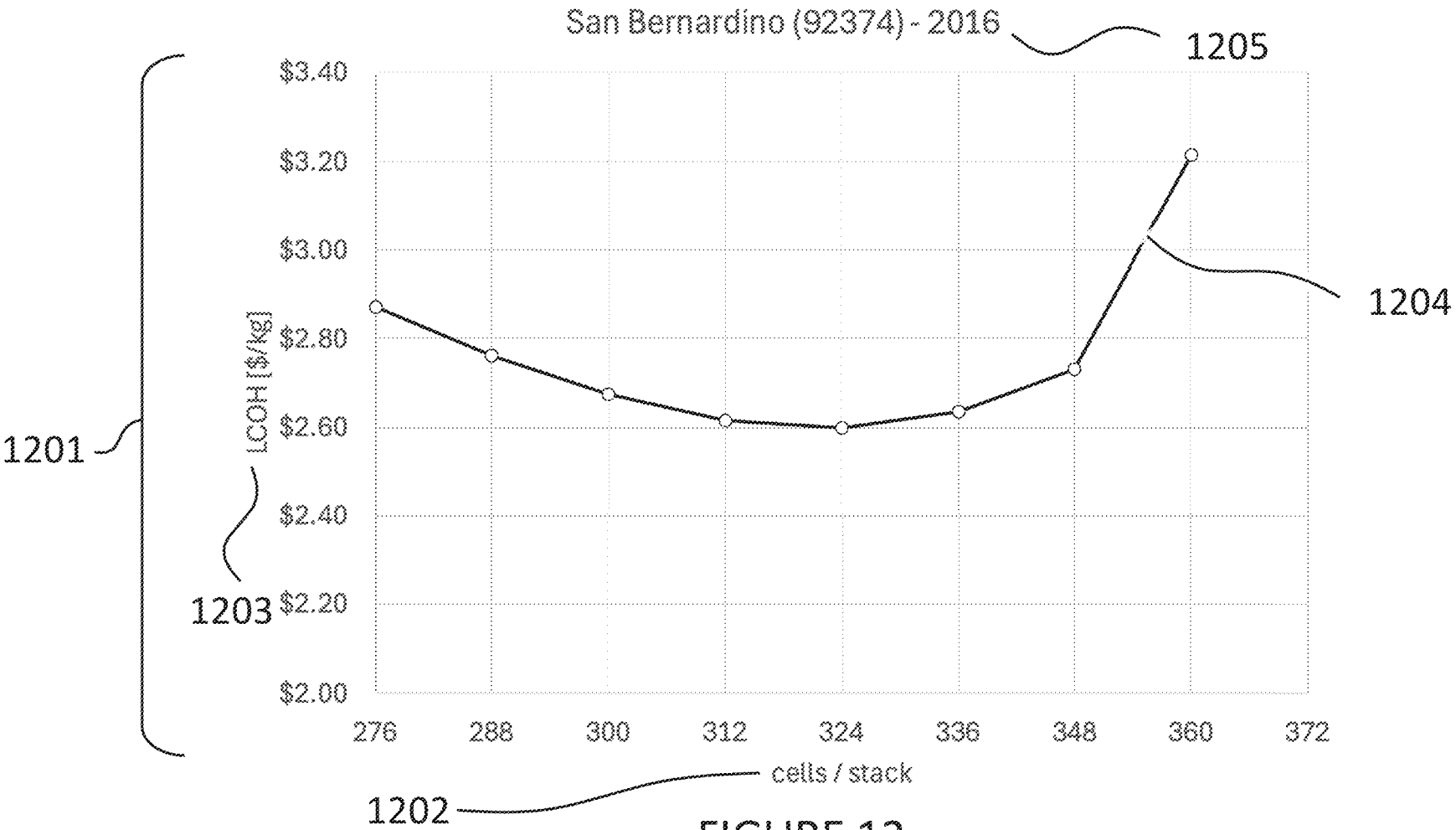
FIG. 12 shows the optimization results for the levelized cost of hydrogen (LCOH) corresponding to FIG. 11.

FIG. 12 illustrates the results of an optimization (1201) for levelized cost of hydrogen—LCOH—(1203, 1204, $/kg) based on the same model and simulation method described in FIG. 9. Similar to FIG. 11, annual, cumulative hydrogen production for 2016 in San Bernardino, CA (1205) was calculated using the model described in FIG. 9 for stacks with different cell counts (1202). The total expected life of those stack was then calculated based on one of two EoL criteria: 1) a maximum allowable cell voltage of 2.25V/cell; or 2) a maximum allowable stack module voltage of 1,500 VDC. A complete, 25-year design life cost model for the CAPEX of the solar-hydrogen plant, including solar PV CAPEX, solar PV operating and maintenance (O&M) costs, electrolyzer stacks & balance of plant (EZ) CAPEX, EZ O&M, and stack replacement costs was created using publicly available solar cost data from NREL and internal cost data for EVOLOH's EZ technology. The results (1204) show that an optimum cell count exists which minimizes the LCOH for the direct DC solar hydrogen system of the present disclosure. In the case of a 1,500 VDC rated solar field and a 24-stack electrolyzer module, both configured as described in FIG. 6, the optimum cell count is 324 cells per stack. The described optimization process may be repeated for any alternate configuration of solar PV system and electrolyzer stack module, and, in general, may indicate the following rules of thumb for selecting the optimum number of cells for a group in an electrolyzer stack module:

1) The IPC-SPC crossing point (FIG. 8, 817) at BoL for the electrolyzer stack module may be less than the rated voltage of the solar PV system. The number of cells in each branch may therefore be in the range specified by equation 12-1:

$$N_c \leq \frac{V_{PM}}{V_{EB}} \quad \text{[equation 12-1]}$$

wherein,

- $N_C$ is number of individual electrolysis cells in each group or branch
- $V_{EB}$ is the rated beginning of life voltage for an individual electrolysis cell
- $V_{PM}$ is the maximum bus voltage of the photovoltaic system 2) The IPC-SPC crossing point (FIG. 8, 817) at BoL for the electrolyzer stack module may be less than the voltage of the solar PV system at MPP. The number of cells in each branch may therefore be in the range specified by equation 12-2:

$$N_c \leq \frac{V_{MPP}}{V_{EB}} \quad \text{[equation 12-2]}$$

wherein,

- $N_C$ is number of individual electrolysis cells in each group or branch
- $V_{EB}$ is the rated beginning of life voltage for an individual electrolysis cell
- $V_{MPP}$ is the maximum peak power voltage of the photovoltaic system at the maximum expected solar irradiance for the installed system (e.g., 1000 W/m$^2$).

3) The IPC-SPC crossing point (FIG. 8, 817) at BoL for the electrolyzer stack module may be greater than a selected fraction of the rated voltage of the solar PV system. The number of cells in each branch may therefore be in the range specified by equation 12-3:

$$N_c \geq \frac{f_{MB} \cdot V_{PM}}{V_{EE}} \quad \text{[equation 12-3]}$$

wherein,

- $N_C$ is number of individual electrolysis cells in each group or branch
- $V_{EE}$ is the rated end of life voltage for an individual electrolysis cell
- $V_{PM}$ is the maximum bus voltage of the photovoltaic system
- $f_{MB}$ is a selected fraction of the maximum bus voltage of the photovoltaic system, and wherein,
- $f_{MB}$ is selected to maximize the lifetime hydrogen production of the system, or, minimize the levelized cost of hydrogen produced over the life of the system.

Exemplary embodiments may include a) values of $V_{EB}$ being 1.5V/cell, 1.6V/cell, 1.7V/cell, 1.8V/cell, or 1.9V/cell, depending on the electrolyzer technology employed; b) values of $V_{PM}$ being 1000 VDC, 1,500 VDC, 2,000 VDC, or 3,000 VDC, depending on the solar system technologies employed; c) values of $f_{MB}$ being 0.95, 0.9, 0.85, or 0.75, depending on the decay rate of the electrolyzer technology employed.

Figure 13:
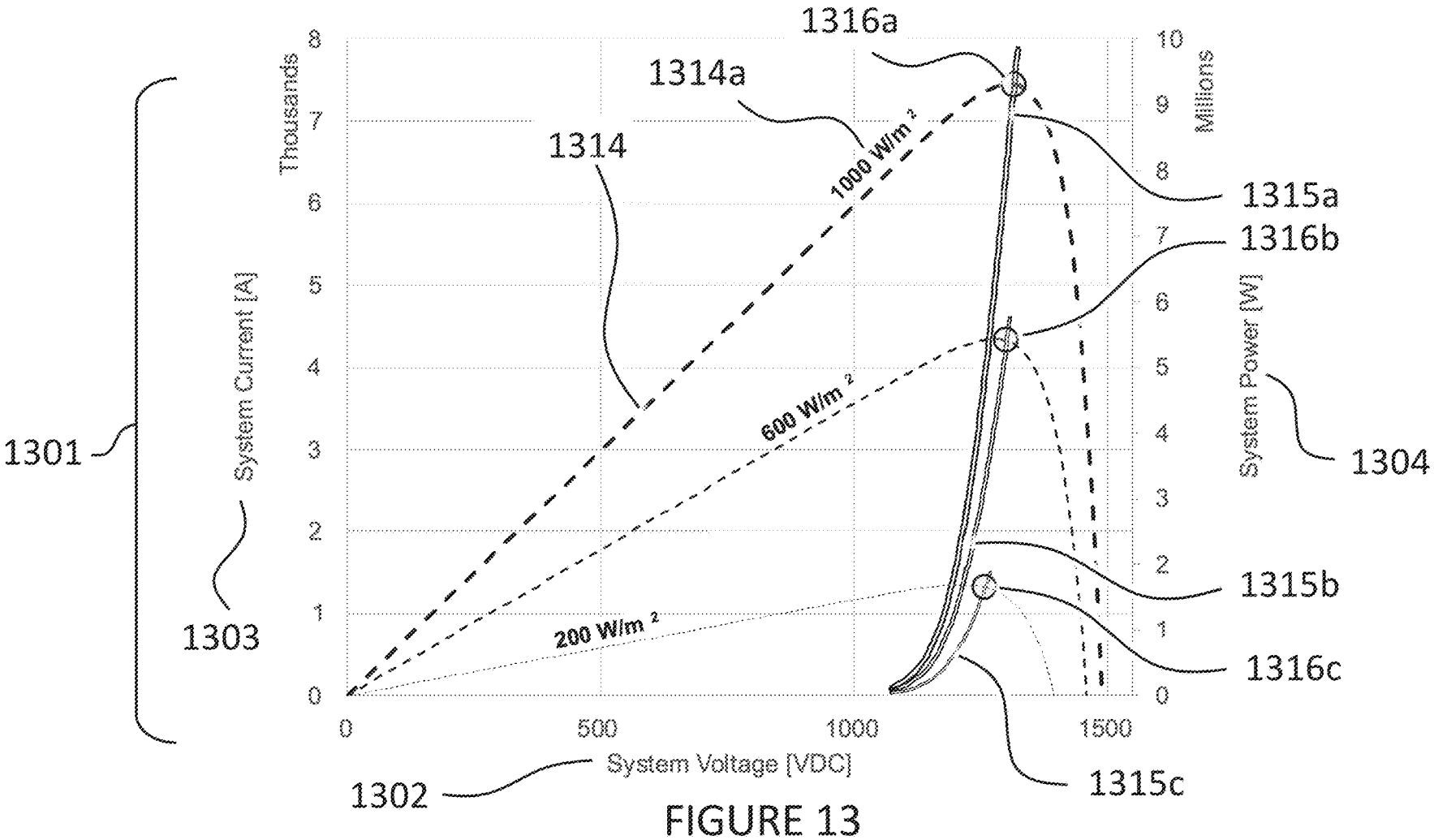
FIG. 13 shows a graph overlaying the impedance polarization characteristic (IPC) curve for a preferred embodiment electrolysis system with the source polarization (SPC) curve for a preferred embodiment solar PV system illustrating the ability of the invention to track maximum peak power of the solar system by simply switching stack branches on or off.

FIG. 13 illustrates an exemplary matching of SPC and IPC curves for the solar PV system and electrolyzer module as configured in FIG. 6 including on-off switches for each branch of the stack module. The SPC for the solar PV system comprises power (1304) vs. current (1303) characteristics as depicted with exemplary curves (1314) at various irradiance values (1314*a*). The IPC for the electrolyzer system comprises voltage (1302) vs. current (1303) characteristics as depicted with exemplary curves (1315*a*, 1315*b*, and 1315*c*). As the number of branches within the electrolyzer stack module is decreased by opening the switches in line with each branch, curve (1315*a*) shifts downward. With all 12 branches active, curve (1315*a*) represents the IPC of the electrolyzer system. If 4 branches are switched off, leaving 8 live branches in the electrolyzer stack module, curve (1315*b*) represents the IPC of the electrolyzer system. Likewise, If 8 branches are switched off, leaving 4 live branches in the electrolyzer stack module, curve (1315*c*) represents the IPC of the electrolyzer system. The points (1316*a*, 1316*b*, and 1316*c*), where the IPC curves cross the SPC power curves represent the natural operating point for the unregulated solar-hydrogen system as branches are switched on or off. This natural operating point may vary as a continuous function of solar irradiance when branch switches are unchanged, but employing switches enables the electrolyzer system to track the MPP of the solar PV system without the cost of active DC power control typical of prior art solar-hydrogen systems.

Embodiments of the present application described herein address the drawbacks of state-of-the-art commercial electrolyzers operating at high DC voltages, including (a) high voltages exposed to the liquid-filled manifolds of the stack creating excessive shunt currents, (b) unwanted adverse reactions (e.g., in the manifolds themselves), and (c) internal cell and stack corrosion. The foregoing embodiments dramatically reduce the electrical stress between electrolyzer components and earth ground. First, symmetric ground referencing using earth-ground reference resistors (313*b*, 323*b*) reduces the maximum voltage-to-ground by half (i.e., in the foregoing embodiments from 1500 VDC to 750 VDC) throughout the system and proportionally reduces the driving force for shunt currents. Second, the opposite orientation of stacks within each branch (e.g., A-bank stacks with positive terminals up, B-bank stacks with positive terminals down) positions the interconnect wiring (708*a*) at mid-potential between the paired stacks, further minimizing voltage differences relative to ground at critical connection points. Third, mid-voltage plumbing connections (both water and hydrogen) are implemented by making all water inlet and hydrogen outlet connections at the mid-voltage connection points between paired stacks, ensuring that fluid-containing components operate at the lowest possible voltage potential relative to earth ground. This approach enables the use of electrolyzer stacks containing more than 300 cells while maintaining the electrical, safety, and corrosion advantages typically associated with much lower voltage systems, thereby overcoming the fundamental scaling limitations that have constrained state-of-the-art commercial electrolyzer designs to 200 cells or less and 360 VDC or less.

The foregoing description of preferred embodiments has been presented for purposes of illustration and description only. It is not intended to be exhaustive or to limit the application to the precise form disclosed, and modifications and variations are possible and/or would be apparent in light of the above teachings or may be acquired from practice of the application. The embodiments were chosen and described in order to explain the principles of the application and its practical application to enable one skilled in the art to utilize the application in various embodiments and with various modifications as are suited to the particular use contemplated. It is intended that the scope of the application be defined by the claims appended hereto and that the claims encompass all embodiments of the application, including the disclosed embodiments and their equivalents.

Further Embodiments

A-1. A renewable energy system comprising:

a renewable energy source producing DC electricity;

an electrochemical device directly connected to receive said DC electricity without intermediate active power conversion.

A-2. The system of A-1, wherein the renewable energy source comprises a plurality of photovoltaic solar panels wired in a series to form photovoltaic strings, a plurality of photovoltaic strings wired in parallel to form a photovoltaic field, and one or more photovoltaic fields wired in parallel to form a photovoltaic system, wherein the number of panels in each string is selected to achieve a predefined maximum bus voltage, wherein the electrochemical device comprises a water electrolyzer stack module connected directly to the unregulated DC bus of the photovoltaic system comprising one or more groups of individual electrolyzer cells, wherein each group of individual electrolyzer cells contains a number of individual electrolysis cells connected in series, wherein the number of cells in each group is selected to (i) achieve a rated operating voltage of the electrolyzer cell groups less than or equal to the photovoltaic system bus voltage at one of the stack's a) beginning of life, b) end of life, or c) middle of life, (ii) maximize the lifetime hydrogen production of the system, or (iii) minimize the levelized cost of hydrogen produced by the system over its lifetime.

A-3. The system of A-2, wherein the total number of groups of individual electrolyzer cells in the water electrolyzer stack module is selected to accept the maximum total current produced by the photovoltaic system at the maximum solar irradiance expected at the installed location.

A-4. The system of A-2 to A-3, wherein the number of cells in each group is selected to achieve an electrolyzer rated voltage less than the bus voltage of the photovoltaic system according to the formula:

$$N_c \leq \frac{V_{PM}}{V_{EB}},$$

wherein $N_C$ is number of individual electrolysis cells in each group $V_{EB}$ is the rated beginning of life voltage for an individual electrolysis cell $V_{PM}$ is the maximum bus voltage of the photovoltaic system.

A-5. The system of A-4, wherein $V_{EB}$ is selected from one of: 1.5V/cell, 1.6V/cell, 1.7V/cell, 1.8V/cell, or 1.9V/cell $V_{PM}$ is selected from one of: 1000 VDC, 1,500 VDC, 2,000 VDC, or 3,000 VDC.

A-6. The system of A-2 to A-3, wherein the number of cells in each group is selected to achieve an electrolyzer rated voltage greater than a selected fraction of the bus voltage of the photovoltaic system according to the formula:

$$N_c \geq \frac{f_{MB} \cdot V_{PM}}{V_{EE}},$$

wherein $N_C$ is number of individual electrolysis cells in each group $V_{EE}$ is the rated end of life voltage for an individual electrolysis cell $V_{PM}$ is the maximum bus voltage of the photovoltaic system $f_{MB}$ is a selected fraction of the maximum bus voltage of the photovoltaic system, wherein, $f_{MB}$ is selected to maximize the lifetime hydrogen production of the system, or, minimize the levelized cost of hydrogen produced over the life of the system.

A-7. The system of A-6, wherein $V_{EB}$ is selected from one of: 1.5V/cell, 1.6V/cell, 1.7V/cell, 1.8V/cell, or 1.9V/cell $V_{PM}$ is selected from one of: 1000 VDC, 1,500 VDC, 2,000 VDC, or 3,000 VDC.

$f_{MB}$ is selected from one of: 0.95, 0.9, 0.85, or 0.75.

A-8. The system of A-2 to A-3, wherein the number of cells in each group is selected to achieve an electrolyzer rated voltage less than or equal to the maximum peak power voltage of the photovoltaic system according to the formula:

$$N_c \leq \frac{V_{MPP}}{V_{EB}},$$

wherein $N_C$ is number of individual electrolysis cells in each group $V_{EB}$ is the rated beginning of life voltage for an individual electrolysis cell $V_{MPP}$ is the maximum peak power voltage of the photovoltaic system A-9. The system of A-2 to A-8, wherein each cell group is configured with one of more disconnect switches to enable the input impedance characteristic of the stack module to be changed dynamically during operation.

A-10. The system of A-2 to A-9, wherein each group of individual electrolyzer cells comprises two physically distinct stacks of cells, wherein the two stacks are wired in series with a mid-voltage connection to form branch pairs in the electrolyzer module, wherein one or more branch pairs are wired in parallel to accept the maximum total current produced by the photovoltaic system at the maximum solar irradiance expected at the installed location, and wherein the positive bus and negative bus of the photovoltaic system are symmetrically referenced to earth ground to achieve generally equal absolute values of DC operating voltage, relative to earth ground, for each bus.

A-11. The system of A-2 to A-10, wherein the individual electrolyzer cells in each stack unit have a pitch less than or equal to 5 mm, 3 mm or 2 mm.

A-12. The system of A-2 to A-11, wherein, the electrolyzer cells comprise an anode electrode configured to provide a low voltage decay rate when exposed to a high number of voltage cycles, and wherein the anode electrode provides a relatively poor performance at beginning of life, and wherein the anode electrode contains no precious group metals or rare earth metals.

A-13. The system of A-10 to A-12, wherein the water inlet connection for each physically distinct stack is made at the end of each stack that corresponds to the mid-voltage connection point of the pair.

A-14. The system of A-10 to A-13, wherein the hydrogen outlet connection for each physically distinct stack is made at the end of each stack that corresponds to the mid-voltage connection point of the pair.

B-1. A method of producing hydrogen comprising:

providing a photovoltaic system having an unregulated DC bus with a predetermined maximum voltage;

providing a water electrolyzer stack module comprising one or more groups of electrolyzer cells connected in series;

directly connecting the electrolyzer stack module to the unregulated DC bus without intermediate voltage regulation;

selecting the number of electrolyzer cells in each group to achieve impedance matching between photovoltaic source polarization characteristics and electrolyzer impedance polarization characteristics;

operating the combined system at natural electrical operating points determined by intersection of the source and impedance polarization characteristics; and producing hydrogen through water electrolysis powered directly by the photovoltaic system.

B-2. The method of B-1, further comprising:

monitoring solar irradiance conditions in real-time;

dynamically switching electrolyzer cell groups on or off in response to changing solar irradiance.

B-3. The method of B-1 to B-2, further comprising:

establishing symmetric ground referencing by connecting the positive bus to earth ground through a first reference resistor and the negative bus to earth ground through a second reference resistor; and maintaining the positive bus at a positive voltage relative to earth ground and the negative bus at a negative voltage relative to earth ground of substantially equal absolute magnitude.

B-4. The method of B-1 to B-3, further comprising:

configuring electrolyzer stacks in paired arrangements with opposite orientations; connecting water inlet and hydrogen outlet plumbing at mid-voltage connection points between paired stacks; and maintaining fluid connections at lowest possible voltage potentials relative to earth ground.

C-1. A method of optimizing solar-to-hydrogen conversion efficiency comprising:

characterizing source polarization characteristics of a photovoltaic system across a range of solar irradiance conditions;

characterizing impedance polarization characteristics of an electrolyzer system across beginning-of-life to end-of-life operation;

determining optimal electrolyzer cell count by modeling intersection points of the polarization characteristics;

configuring the electrolyzer system with the determined optimal cell count; and operating the directly-coupled system to achieve maximum annual hydrogen production.

C-2. The method of C-1, further comprising:

simulating annual hydrogen production using historical solar irradiance data;

calculating levelized cost of hydrogen for different cell count configurations;

identifying cell count that minimizes levelized cost of hydrogen; and implementing the identified optimal configuration.

D-1. A method of enabling maximum power point tracking without active power electronics comprising:

configuring multiple parallel branches of series-connected electrolyzer cells;

providing disconnect switches for individual branches;

monitoring photovoltaic system operating conditions; and selectively connecting or disconnecting electrolyzer branches to modify system impedance characteristics.

E-1. Use of an unregulated photovoltaic DC bus for directly powering water electrolysis without intermediate power conversion, wherein at least 95% of electrolyzer operating power is provided directly from the DC bus.

What is claimed is:

1. A renewable energy system comprising:

a renewable energy source producing DC electricity;

an electrochemical device directly connected to receive said DC electricity without intermediate active power conversion, wherein the renewable energy source comprises a plurality of photovoltaic solar panels wired in a series to form photovoltaic strings, a plurality of photovoltaic strings wired in parallel to form a photovoltaic field, and a plurality of photovoltaic fields wired in parallel to form a photovoltaic system, wherein the number of panels in each string is selected to achieve a predefined maximum bus voltage, wherein the electrochemical device comprises a water electrolyzer stack module connected directly to the unregulated DC bus of the photovoltaic system comprising one or more groups of individual electrolyzer cells, wherein each group of individual electrolyzer cells contains a number of individual electrolysis cells connected in series, wherein the number of cells in each group is selected to (i) achieve a rated operating voltage of the electrolyzer cell groups less than or equal to the photovoltaic system bus voltage at one of the stack's a) beginning of life, b) end of life, or c) middle of life, (ii) maximize the lifetime hydrogen production of the renewable energy system, or (iii) minimize the levelized cost of hydrogen produced by the renewable energy system over its lifetime, wherein each group of individual electrolyzer cells comprises two physically distinct stacks of cells, wherein the two stacks are wired in series with a mid-voltage connection to form branch pairs in the electrolyzer module, wherein one or more branch pairs are wired in parallel to accept the maximum total current produced by the photovoltaic system at the maximum solar irradiance expected at the installed location, wherein a positive bus and a negative bus of a direct current (DC) bus connecting the renewable energy source to the electrochemical device are symmetrically referenced to earth ground to achieve generally equal absolute values of DC operating voltage, relative to earth ground, for each bus.

2. The system of claim 1, wherein the total number of groups of individual electrolyzer cells in the water electrolyzer stack module is selected to accept the maximum total current produced by the photovoltaic system at the maximum solar irradiance expected at the installed location.

3. The system of claim 1, wherein the number of cells in each group is selected to achieve an electrolyzer rated voltage less than the bus voltage of the photovoltaic system according to the formula:

$$N_c \leq \frac{V_{PM}}{V_{EB}},$$

wherein $N_C$ is number of individual electrolysis cells in each group $V_{EB}$ is the rated beginning of life voltage for an individual electrolysis cell $V_{PM}$ is the maximum bus voltage of the photovoltaic system.

4. The system of claim 3, wherein $V_{EB}$ is selected from one of: 1.5V/cell, 1.6V/cell, 1.7V/cell, 1.8V/cell, or 1.9V/cell $V_{PM}$ is selected from one of: 1000 VDC, 1,500 VDC, 2,000 VDC, or 3,000 VDC.

5. The system of claim 1, wherein the number of cells in each group is selected to achieve an electrolyzer rated voltage greater than a selected fraction of the bus voltage of the photovoltaic system according to the formula:

$$N_c \geq \frac{f_{MB} \cdot V_{PM}}{V_{EE}},$$

wherein $N_C$ is number of individual electrolysis cells in each group $V_{EE}$ is the rated end of life voltage for an individual electrolysis cell $V_{PM}$ is the maximum bus voltage of the photovoltaic system $f_{MB}$ is a selected fraction of the maximum bus voltage of the photovoltaic system, wherein, $f_{MB}$ is selected to maximize the lifetime hydrogen production of the system, or, minimize the levelized cost of hydrogen produced over the life of the system.

6. The system of claim 5, wherein $V_{EE}$ is selected from one of: 1.5V/cell, 1.6V/cell, 1.7V/cell, 1.8V/cell, or 1.9V/cell $V_{PM}$ is selected from one of: 1000 VDC, 1,500 VDC, 2,000 VDC, or 3,000 VDC $f_{MB}$ is selected from one of: 0.95, 0.9, 0.85, or 0.75.

7. The system of claim 1, wherein the number of cells in each group is selected to achieve an electrolyzer rated voltage less than or equal to the maximum peak power voltage of the photovoltaic system according to the formula:

$$N_c \leq \frac{V_{MPP}}{V_{EB}},$$

wherein $N_C$ is number of individual electrolysis cells in each group $V_{EB}$ is the rated beginning of life voltage for an individual electrolysis cell $V_{MPP}$ is the maximum peak power voltage of the photovoltaic system.

8. The system of claim 1, wherein each cell group is configured with one or more disconnect switches to enable the input impedance characteristic of the stack module to be changed dynamically during operation.

9. The system of claim 1, wherein the individual electrolyzer cells in each stack unit have a pitch less than or equal to 5 mm, 3 mm or 2 mm.

10. The system of claim 1, wherein the electrolyzer cells comprise an anode electrode configured to provide a low voltage decay rate when exposed to a high number of voltage cycles, and wherein the anode electrode provides a relatively poor performance at beginning of life, and wherein the anode electrode contains no precious group metals or rare earth metals.

11. The system of claim 1, wherein a water inlet connection for each physically distinct stack is made at the end of each stack that corresponds to the mid-voltage connection point of the pair.

12. The system of claim 1, wherein a hydrogen outlet connection for each physically distinct stack is made at the end of each stack that corresponds to the mid-voltage connection point of the pair.

13. A method of producing hydrogen comprising:

providing the renewable energy system according to claim 1, wherein the renewable energy source comprises the photovoltaic system having an unregulated DC bus with a predetermined maximum voltage, wherein the electrochemical device comprises the water electrolyzer stack module comprising one or more groups of electrolyzer cells connected in series;

directly connecting the electrolyzer stack module to the unregulated DC bus without intermediate voltage regulation;

selecting the number of electrolyzer cells in each group to achieve impedance matching between photovoltaic source polarization characteristics and electrolyzer impedance polarization characteristics;

operating the renewable energy system at natural electrical operating points determined by intersection of the source and impedance polarization characteristics; and producing hydrogen through water electrolysis powered directly by the photovoltaic system.

14. The method of claim 13, further comprising:

monitoring solar irradiance conditions in real-time;

dynamically switching electrolyzer cell groups on or off in response to changing solar irradiance.

15. The method of claim 13, further comprising:

establishing symmetric ground referencing by connecting the positive bus to earth ground through a first reference resistor and the negative bus to earth ground through a second reference resistor; and maintaining the positive bus at a positive voltage relative to earth ground and the negative bus at a negative voltage relative to earth ground of substantially equal absolute magnitude.

16. The method of claim 13, further comprising:

configuring electrolyzer stacks in paired arrangements with opposite orientations; connecting water inlet and hydrogen outlet plumbing at mid-voltage connection points between paired stacks; and maintaining fluid connections at lowest possible voltage potentials relative to earth ground.

17. A method of optimizing solar-to-hydrogen conversion efficiency comprising:

providing the renewable energy system according to claim 1, wherein the renewable energy source comprises the photovoltaic system having an unregulated DC bus with a predetermined maximum voltage, wherein the electrochemical device comprises an electrolyzer system;

characterizing source polarization characteristics of the photovoltaic system across a range of solar irradiance conditions;

characterizing impedance polarization characteristics of an electrolyzer system across beginning-of-life to end-of-life operation;

determining optimal electrolyzer cell count by modeling intersection points of the polarization characteristics;

configuring the electrolyzer system with the determined optimal cell count; and operating the directly-coupled system to achieve maximum annual hydrogen production.

18. The method of claim 17, further comprising:

simulating annual hydrogen production using historical solar irradiance data;

calculating levelized cost of hydrogen for different cell count configurations;

identifying cell count that minimizes levelized cost of hydrogen; and implementing the identified optimal configuration.

* * * * *